US011602189B2

(12) United States Patent
Greenberger

(10) Patent No.: US 11,602,189 B2
(45) Date of Patent: Mar. 14, 2023

(54) REMOVABLE COOLING APPARATUS FOR A HAT

(71) Applicant: Hal P. Greenberger, Natick, MA (US)

(72) Inventor: Hal P. Greenberger, Natick, MA (US)

( * ) Notice: Subject to any disclaimer, the term of this patent is extended or adjusted under 35 U.S.C. 154(b) by 0 days.

(21) Appl. No.: 17/178,181

(22) Filed: Feb. 17, 2021

(65) Prior Publication Data

US 2022/0256959 A1 Aug. 18, 2022

(51) Int. Cl.

| | |
|---|---|
| ***A42C 5/04*** | (2006.01) |
| ***A42B 1/008*** | (2021.01) |
| ***A42B 1/24*** | (2021.01) |
| *A42B 1/0182* | (2021.01) |
| *A42C 5/02* | (2006.01) |

(52) U.S. Cl.

CPC ..... *A42C 5/04* (2013.01); *A42B 1/008* (2013.01); *A42B 1/24* (2013.01); *A42B 1/0182* (2021.01); *A42C 5/02* (2013.01)

(58) Field of Classification Search

CPC .... A42C 5/02; A42C 5/04; A42C 5/00; A42B 1/008; A42B 1/24; A42B 1/205; A42B 1/22; A42B 1/0182; A42B 3/28; A42B 3/281; A42B 3/283

See application file for complete search history.

(56) References Cited

U.S. PATENT DOCUMENTS

| | | | | | |
|---|---|---|---|---|---|
| 30,643 | A * | 11/1860 | Pollack | A42C 5/02 | 2/181.8 |
| 917,873 | A * | 4/1909 | Johnson | A42C 5/02 | 2/181.8 |
| 928,384 | A * | 7/1909 | Hollenbeck | A42C 5/04 | 2/181.6 |
| 936,117 | A * | 10/1909 | Glascock | A42C 5/02 | 2/182.6 |
| 941,717 | A * | 11/1909 | Kolsch | A42C 5/02 | 2/182.3 |
| 960,251 | A * | 6/1910 | Beenken | A42C 5/04 | 2/181.6 |
| 987,501 | A * | 3/1911 | Smith | A42C 5/02 | 2/181.8 |
| 1,062,025 | A * | 5/1913 | Nichols | A42C 5/02 | 2/181.8 |

(Continued)

FOREIGN PATENT DOCUMENTS

| | | | |
|---|---|---|---|
| CN | 202603722 U | | 12/2012 |
| KR | 20090005538 U | * | 6/2009 |

*Primary Examiner* — Amy Vanatta

(74) *Attorney, Agent, or Firm* — Hal P. Greenberger

(57) ABSTRACT

A removable cooling apparatus for a hat spaces a headband of the hat away from a wearer's head, creating an air gap that allows air flow over the wearer's head. A removable cooling apparatus uses coupling structures to hold the removable cooling apparatus in place against the headband. The removable cooling apparatus can be removed completely from the hat when not needed or for cleaning, leaving the hat in an unaltered state. A removable cooling apparatus may use a thin flexible strip to keep the headband of the hat from falling open into the air gap created by the removable cooling apparatus. The removable cooling apparatus use compressible pads to space the headband away from the wearer's head. The contact location of the compressible pads with the wearer's head can be easily adjusted by the wearer.

18 Claims, 12 Drawing Sheets

(56) References Cited

U.S. PATENT DOCUMENTS

| | | | | | |
|---|---|---|---|---|---|
| 1,170,052 | A * | 2/1916 | Diener | A42C 5/04 | 2/181.6 |
| 1,207,137 | A * | 12/1916 | Clore | A42C 5/02 | 2/181.8 |
| 1,421,139 | A * | 6/1922 | Anderson | A42C 5/02 | 2/181 |
| 1,609,715 | A * | 12/1926 | Hess | A42C 5/02 | 2/181.2 |
| 1,655,773 | A * | 1/1928 | Peterson | A42C 5/02 | 2/182.2 |
| 2,129,798 | A * | 9/1938 | Trumbull | A42C 5/04 | 2/182.7 |
| 2,181,446 | A * | 11/1939 | Ames | A42B 1/0184 | 2/171.4 |
| 2,417,616 | A | 3/1947 | Ryniker | | |
| 2,445,209 | A * | 7/1948 | Clark | A42C 5/04 | 2/181 |
| 2,818,574 | A * | 1/1958 | Burnison | A42C 5/04 | 2/181.2 |
| 4,101,981 | A | 7/1978 | Boden | | |
| 4,274,157 | A | 6/1981 | Boden | | |
| 4,951,320 | A | 8/1990 | Yeon | | |
| 5,101,516 | A | 4/1992 | Scarnato | | |
| 5,495,622 | A | 3/1996 | Kaufman | | |
| 5,566,395 | A | 10/1996 | Nebeker | | |
| 5,603,728 | A | 2/1997 | Pachys | | |
| 5,625,901 | A | 5/1997 | Healy | | |
| 5,819,318 | A | 10/1998 | Tse | | |
| 5,855,023 | A | 1/1999 | Clingenpeel et al. | | |
| 5,926,849 | A | 7/1999 | Boyle | | |
| 6,199,214 | B1 | 3/2001 | Cambell | | |
| 6,370,697 | B1 | 4/2002 | Held | | |
| 7,398,560 | B1 | 7/2008 | Swensen | | |
| 2002/0050000 | A1* | 5/2002 | Held | A42C 5/04 | 2/184.5 |
| 2005/0229289 | A1 | 10/2005 | Cote | | |
| 2007/0199132 | A1* | 8/2007 | Lehmann | A42C 5/02 | 2/181 |
| 2008/0163406 | A1 | 7/2008 | Solari | | |
| 2009/0241240 | A1 | 10/2009 | Han | | |
| 2013/0263358 | A1 | 10/2013 | Fleischmann | | |
| 2015/0020292 | A1 | 1/2015 | Diaz et al. | | |
| 2017/0215513 | A1 | 8/2017 | Crunk | | |
| 2022/0007776 | A1* | 1/2022 | Andersson | A42C 5/04 | |
| 2022/0142288 | A1* | 5/2022 | Kim | A42C 5/02 | |

* cited by examiner

REMOVABLE COOLING APPARATUS FOR A HAT

BACKGROUND

This disclosure relates to apparatus and methods for improving cooling of hats. When a person wears a hat such as a baseball cap, the hat sits tightly around the wearer's head. The hat blocks natural air currents from convectively cooling the wearer's head. Perspiration, rather than directly evaporating off the wearer's head into the air thereby removing heat from the wearer's head, soaks into the hat. The moisture is held by the fibers of the hat material slowing evaporation and reducing cooling of the wearer's head. When the soaked in perspiration eventually does evaporate, mineral residue is left behind which discolors the hat.

SUMMARY

All examples and features mentioned below can be combined in any technically possible way.

In one aspect, a removable cooling apparatus for a hat includes a first thin flexible strip having a width, the first thin flexible strip constructed and arranged to elastically deform to conform to the curvature of a headband of a hat, one or more compressible pads, and; coupling structures for removably coupling the first thin flexible strip to the headband of the hat, the coupling structures having a width, height and thickness, wherein the coupling structures are constructed and arranged to apply a coupling force to hold the first thin flexible strip in place against the headband, wherein the coupling structures are further constructed and arranged to allow repeated coupling and uncoupling of the first thin flexible strip to the headband of the hat without substantive degradation of an ability of the coupling structures to hold the thin flexible strip in place against the headband, wherein the removable cooling apparatus is constructed and arranged so that when the removable cooling apparatus is completely removed from the hat, the hat is in an unaltered state, and wherein the removable cooling apparatus is constructed and arranged so that when the removable cooling apparatus is coupled to the hat and the hat is worn by a wearer, the one or more compressible pads contact a head of the wearer.

Embodiments may include one of the following features, or any combination thereof. The one or more compressible pads are repositionable with respect to the first thin flexible strip. The one or more compressible pads are permanently fixed to the first thin flexible strip. The coupling structures are constructed and arranged to be slideable relative to the headband of the hat. The one or more compressible pads are affixed to the slideable coupling structures. The coupling structures include spring clips. The spring clips further include a retaining feature that extends outward from the body of the clip toward the headband to help retain the first thin flexible strip in place within the clip after it has been inserted into the clip, when the clip is coupled to the headband.

The coupling structures are formed integral with the first thin flexible strip.

The first thin flexible strip is constructed and arranged to be slideable along the headband of the hat when the removable cooling apparatus is coupled to the hat. The first thin flexible strip has a first thickness, wherein the first thickness is less than 1.5 mm.

The one or more compressible pads have an uncompressed thickness, wherein the uncompressed thicknesses of each of the one or more compressible pads are less than 25 mm. The one or more compressible pads together have a combined projected planar surface area for contact with the wearer's head of between 400 and 2000 sq mm. The one or more compressible pads comprise a polymeric foam substrate with an attached fabric top layer, the compressible pads constructed and arranged so that when the removable cooling apparatus is coupled to the hat and the hat is worn by the wearer, the fabric top layer contacts the wearer's head. The one or more compressible pads comprise at least first and second compressible pads positioned on the first thin flexible strip such that first and second ends of the thin flexible strip each extend beyond outer extent of the one or more compressible pads by a distance at least as great as the width of one coupling structure.

The removable cooling apparatus further includes a second thin flexible strip and the one or more compressible pads comprise at least first and second compressible pads, wherein the first compressible pad is fixed to the first thin flexible strip and the second compressible pad is fixed to the second thin flexible strip. The removable cooling apparatus further includes a third thin flexible strip, wherein each of the first and second thin flexible strips is coupled to the third thin flexible strip, wherein the first and second thin flexible strips are repositionable with respect to the third thin flexible strip.

The one or more compressible pads comprises at least first and second compressible pads, wherein the first and second compressible pads are spaced apart a distance, wherein the distance is greater than the width of a coupling structure and is less than 120 mm. The one or more compressible pads comprise first, second and third compressible pads that are each coupled to the first thin flexible strip, wherein the third compressible pad is located between the first and second compressible pads, wherein an uncompressed thickness of the first and second compressible pads is less than an uncompressed thickness of the third compressible pad.

In another aspect, a removable cooling apparatus for a hat includes first and second removable coupling structures constructed and arranged to couple to a headband of the hat without requiring modification of the hat, and first and second compressible pads fixed to first and second surfaces of the first and second coupling structures, wherein the removable coupling structures apply a coupling force to hold the removable coupling structures in place on the headband of the hat, the removable coupling structures constructed and arranged to allow repeated coupling and uncoupling of the removable coupling structures to the headband of the hat without significant degradation of the applied coupling force, wherein the removable coupling structures are further constructed and arranged to be completely removable from the hat, wherein the first and second coupling structures are further constructed and arranged so that when the first and second coupling structures are coupled to the headband of the hat, the first and second coupling structures are slideable relative to the headband of the hat to enable adjustment of the positions of the compressible pads relative to a head of a wearer of the hat.

In another aspect, a method for coupling a removable cooling apparatus to a hat includes inserting a first coupling structure onto a headband of the hat, inserting a second coupling structure onto the headband of the hat, wherein the first and second coupling structures are spaced a distance apart along the headband, inserting a first portion of a thin flexible strip into the first coupling structure, the first portion of the thin flexible strip held in place within the first coupling structure by a first retaining step, and; inserting a second portion of the thin flexible strip into the second coupling structure, the second portion of the thin flexible strip held in place within the second coupling structure by a second retaining step.

BRIEF DESCRIPTION OF THE DRAWINGS

Various aspects of at least one example are discussed below with reference to the accompanying figures, which are not intended to be drawn to scale. The figures are included to provide illustration and a further understanding of the various aspects and examples, and are incorporated in and constitute a part of this specification, but are not intended as a definition of the limits of the inventions. In the figures, identical or nearly identical components illustrated in various figures may be represented by a like reference character or numeral. For purposes of clarity, not every component may be labeled in every figure. In the figures.

DETAILED DESCRIPTION

Figure 1:
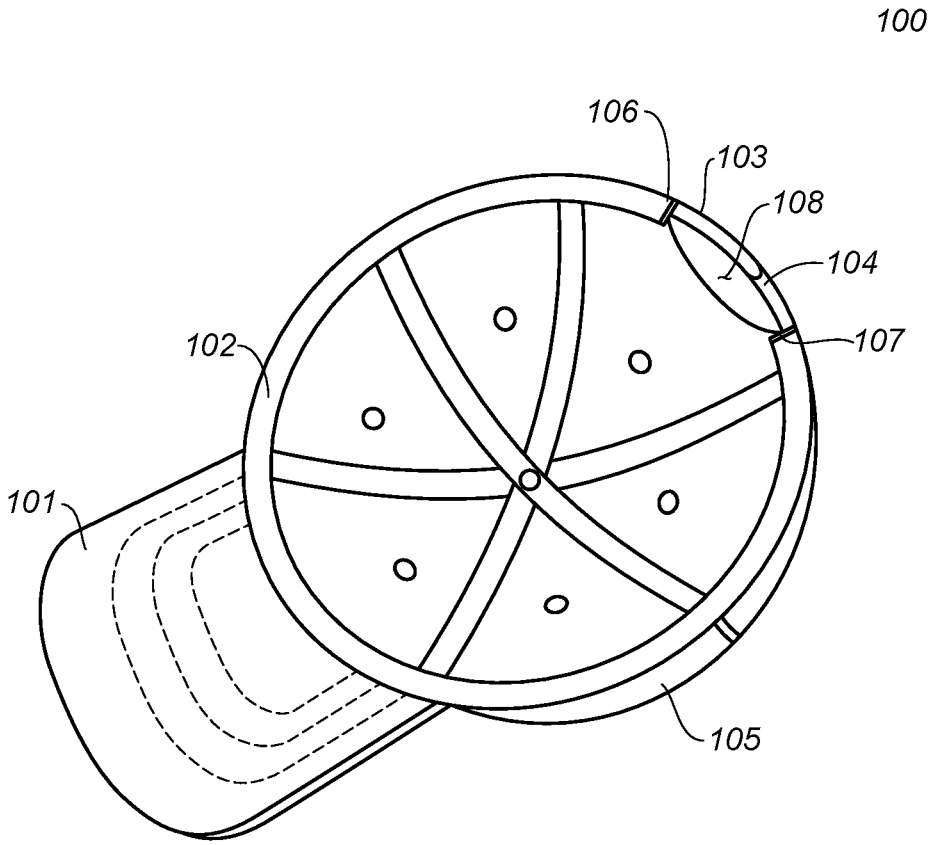
FIG. 1 is a perspective view of the inside of a hat.

Examples of the methods, systems, and apparatuses discussed herein are not limited in application to the details of construction and the arrangement of components set forth in the following description or illustrated in the accompanying drawings. The methods and apparatuses are capable of implementation in other examples and of being practiced or of being carried out in various ways. Examples of specific implementations are provided herein for illustrative purposes only and are not intended to be limiting. In particular, functions, components, elements, and features discussed in connection with any one or more examples are not intended to be excluded from a similar role in any other examples.

Examples disclosed herein may be combined with other examples in any manner consistent with at least one of the principles disclosed herein, and references to "an example," "some examples," "an alternate example," "various examples," "one example" or the like are not necessarily mutually exclusive and are intended to indicate that a particular feature, structure, or characteristic described may be included in at least one example. The appearances of such terms herein are not necessarily all referring to the same example.

Also, the phraseology and terminology used herein is for the purpose of description and should not be regarded as limiting. Any references to examples, components, elements, acts, or functions of the products, systems and methods herein referred to in the singular may also embrace embodiments including a plurality, and any references in plural to any example, component, element, act, or function herein may also embrace examples including only a singularity. Accordingly, references in the singular or plural form are not intended to limit the presently disclosed systems or methods, their components, acts, or elements. The use herein of "including," "comprising," "having," "containing," "involving," and variations thereof is meant to encompass the items listed thereafter and equivalents thereof as well as additional items. References to "or" may be construed as inclusive so that any terms described using "or" may indicate any of a single, more than one, and all of the described terms.

Hats are worn to provide an ornamental look, but also to protect a wearer against the environment. One benefit of a hat is to protect the wearer's head from the effects of the sun's UV radiation. Hats often have a brim that extends forward of the forehead to shade the wearer's face. Hats are effective in blocking UV but can become uncomfortable as the environmental temperature rises as they also block air from reaching the wearer's head (including the wearer's forehead). The effectiveness of the body's natural cooling system of evaporation of perspiration off the skin of the wearer's head is substantially reduced.

It is desirable to maintain the beneficial functions of the hat of blocking UV and providing an ornamental look while reducing the negative impact on the body's natural cooling ability. Example removable cooling devices disclosed herein provide a path for air flow directly over the wearers head and forehead that allows existing hats to be worn and held in place while restoring the effectiveness of the body's natural cooling system, while maintaining physical comfort. Removable cooling devices include structures that space the front portion of a hat away from a user's forehead creating an air gap between the hat and the wearer's forehead. It is desirable to expose the wearer's forehead to increased air flow because the forehead exposes the wearer's skin directly to the air flow, making cooling more effective. To maximize air flow and cooling, the structures should contact the wearer's head over as small an area as practical. However, reducing the contact area increases the pressure applied, for a desired holding force needed to keep the hat from easily blowing off the wearer's head, which reduces mechanical comfort and places a lower practical limit on contact area.

Spacing a large portion of the front of a hat away from the wearer's forehead also substantially reduce the transport of perspiration into the hat material, as the perspiration is evaporated off the wearer's forehead rather than being absorbed into the hat material. This reduces discoloration from mineral deposits left behind that can occur when a perspiration-soaked hat dries out.

FIG. 1 depicts a perspective view of the underside of a typical baseball cap 100 having brim 101 for shading the wearer's face, cap portion 105 that covers the top of the wearer's head, size adjustment features 103 and 104, and headband 102. Though FIG. 1 depicts a baseball style cap, example cooling devices disclosed may be used with any style hat that incorporates a headband such as headband 102. Headband 102 of hat 100 extends around the interior circumference of hat 100 about its base and terminates near ends 106 and 107 of opening 108. Users can removably attach example cooling devices to headband 102 of hat 100 in the region where brim 101 is coupled to cap section 105.

Figure 2A:
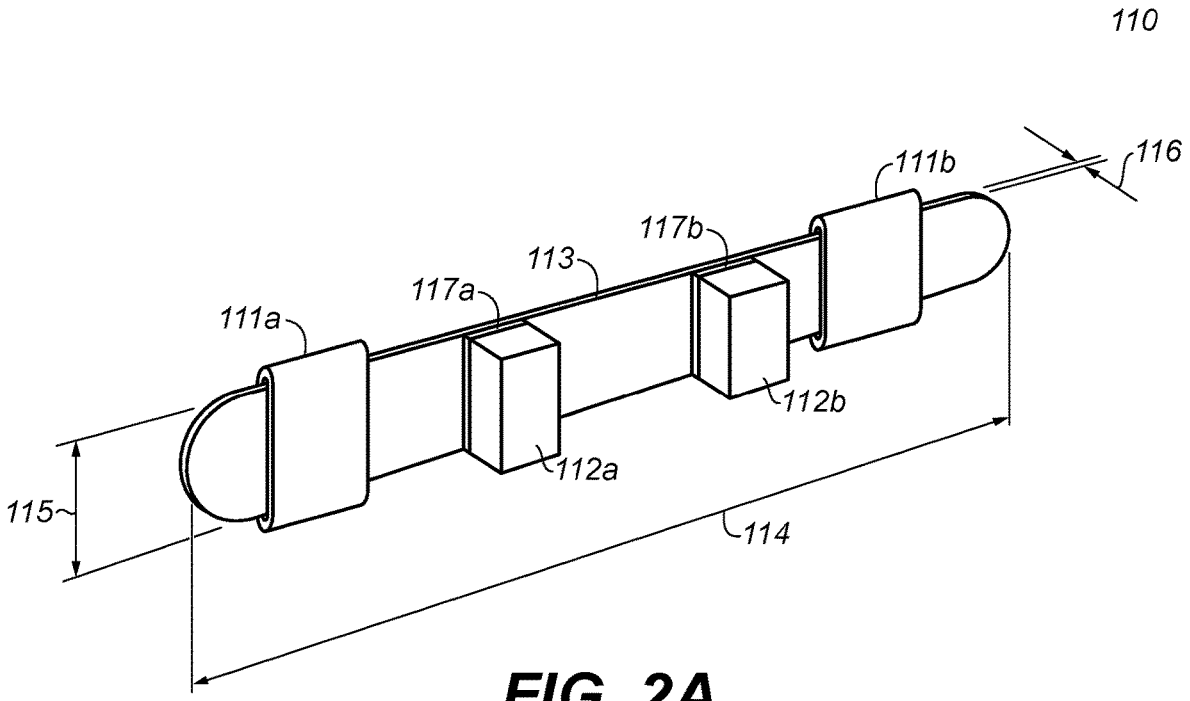
FIG. 2A is a perspective view of one example of a removable cooling device for a hat.
Figure 2B:
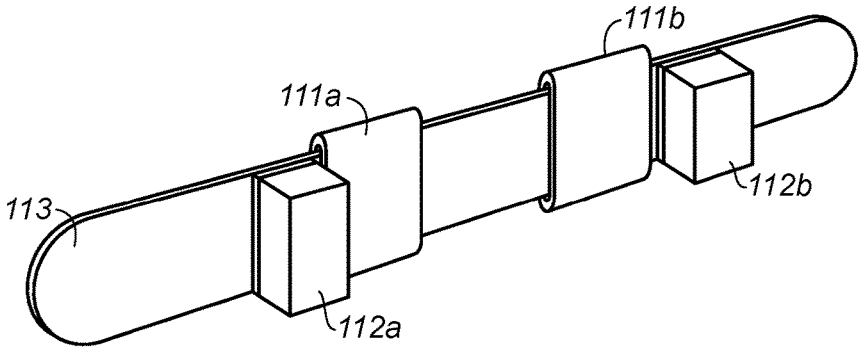
FIG. 2B is a perspective view of one example of a removable cooling device for a hat.
Figure 3:
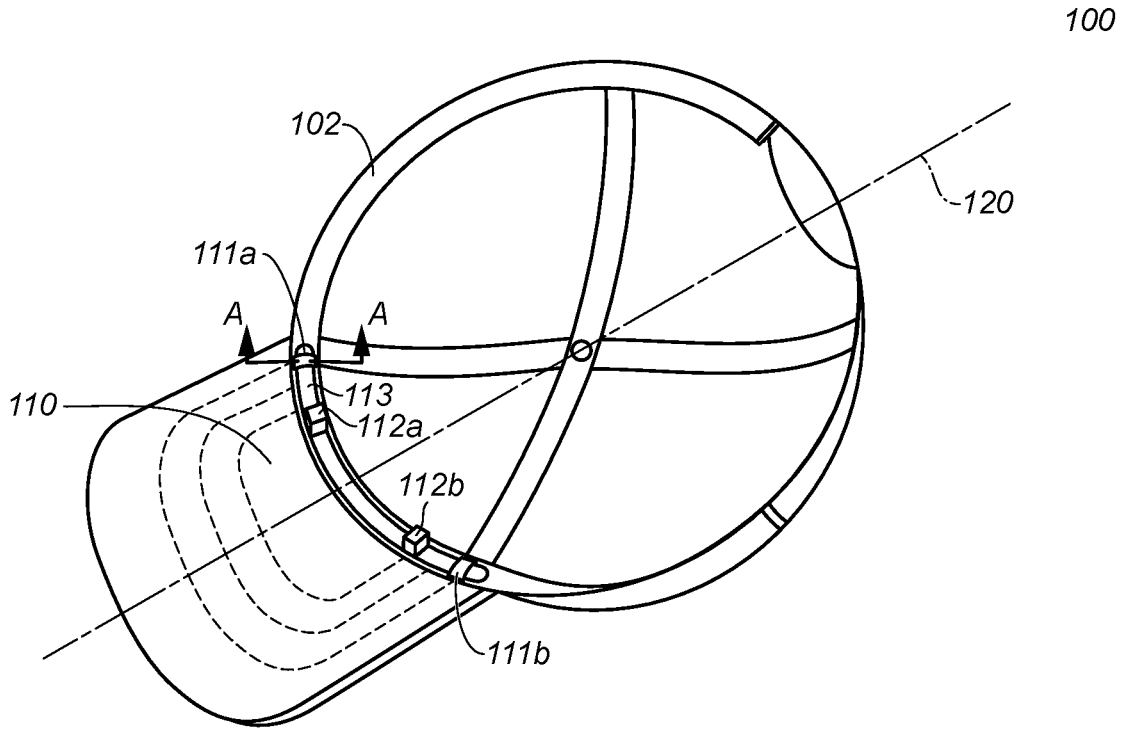
FIG. 3 is a perspective view of the inside of a hat with one example of a removable cooling device installed in the hat.

FIGS. 2A and 2B depict example cooling device 110 with two relative positions of coupling structurers. FIG. 3 depicts cooling device 110 installed in baseball style cap 100 of FIG. 1 with the orientation of coupling structures shown in FIG. 2A. It should be noted that cooling device 110 or any other example devices disclosed herein are not limited in the types of hats to which they can be coupled.

Figure 10:
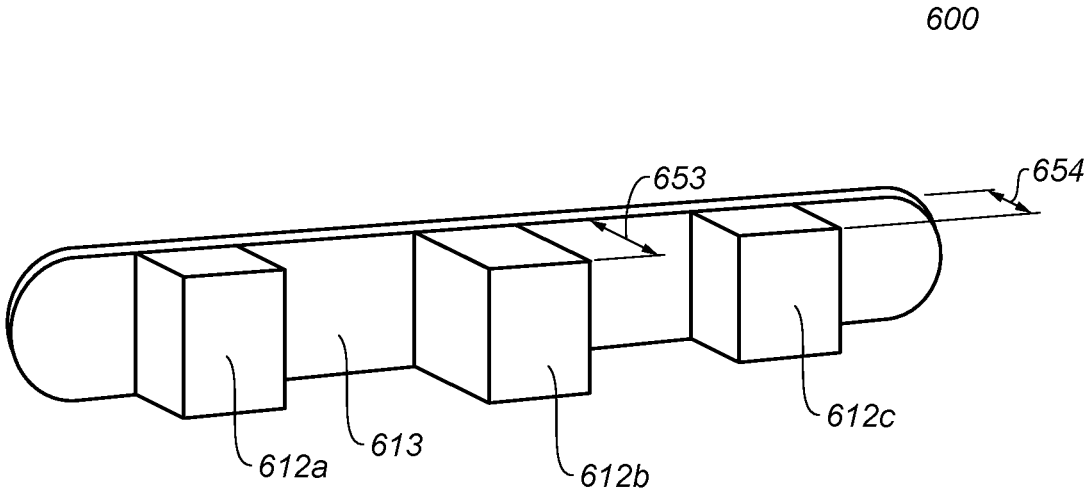
FIG. 10 is a perspective view of one example of a removable cooling device for a hat having three compressible pads, at least two having different thicknesses.

Referring now to FIG. 2A, cooling device 110 includes thin flexible strip 113 to which compressible pads 112*a* and 112*b* are affixed. Compressible pads 112*a* and 112*b* create a gap between thin flexible strip 113 and a wearer's forehead when hat 100 is worn with cooling device 110 installed. Cooling device 110 depicts two separate compressible pads affixed to the thin flexible strip but other examples may use a different number of compressible pads. Some example cooling devices may centrally locate a single compressible pad on a thin flexible strip. Single pad cooling device examples are described in more detail with respect to FIGS. 6A and 6B. Some examples have more than two compressible pads attached to a thin flexible strip. FIG. 10 depicts one example cooling device with three compressible pads affixed to a thin flexible strip, though more pads are also contemplated.

Thin flexible strip 113 is coupled to headband 102 with a pair of coupling structures, shown as clips 111*a* and 111*b* (clip 111*a* is shown in more detail in FIG. 4), where the height 115 of thin flexible strip 113 fits completely within internal gap height 139 of clips 111*a* and 111*b*. In FIG. 2A, clips 111*a* and 111*b* are shown sitting outboard of compressible pads 112*a* and 112*b*. For clips 111*a* and 111*b* to be positioned as shown, the portions of thin flexible strip 113 that extend beyond the outer ends of compressible pads 112*a* and 112*b* should be at least as great as the widths 130 of clips 111*a* and 111*b* respectively. For clips 111*a* and 111*b* to be located as shown in FIG. 2B, the portion of thin flexible strip 113 extending between the inward facing sides of compressible pads 112*a* and 112*b* should be at least as great as the combined widths 130 of clips 111*a* and 111*b* (which is two times the width 130 when clips 11*a* and 11*b* are identical).

Compressible pads 112*a* and 112*b* may be permanently or repositionably coupled to thin flexible strip 113 using a pressure sensitive adhesive 117*a* and 117*b* or other adhesive applied to the rear of the compressible pads 112*a* and 112*b*. The adhesives can provide either a permanent bond or a repositionable bond. Repositionable bonds allow the location of the pads along the thin flexible strip to be easily changed. However, repositionable adhesives lose their bond strength after just a few bond and un-bond cycles.

In some examples, a 2-part hook and loop fastening system (described in more detail with respect to FIG. 5B) is used to allow compressible pads to be repositionable with respect to the thin flexible strip, where one part of the hook and loop fastening system is affixed (with permanent adhesive) to the rear side of compressible pads 112*a* and 112*b* and the $2^{nd}$ part of the hook and loop fastening system is permanently fixed to thin flexible strip 113. The 2-part hook and loop fasteners allow the compressible pads 112 to be easily repositioned along the section of thin flexible strip 113 where the $2^{nd}$ part of the hook and loop fastener is located. Adding a 2-part hook and loop fastening system as described, while providing the ability to easily reposition compressible pads, adds cost to the product. Additionally, the added hook and loop fastening system components may fill up a portion of the air gap between the thin flexible strip and the wearer's head with the $2^{nd}$ part of the hook and loop fastening system, potentially reducing cooling effectiveness.

Figure 8:
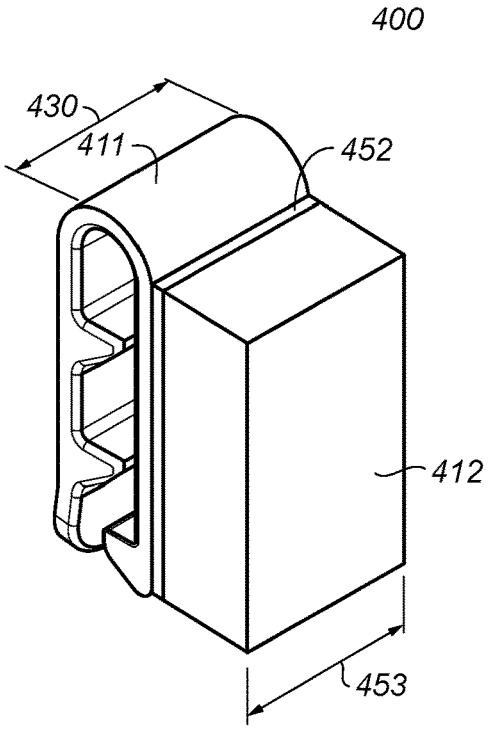
FIG. 8 is a perspective view of one example of a removable cooling device for a hat having a compressible pad mounted directly to a coupling structure for coupling the removable cooling device to a hat.

It is desirable to allow a wearer of a hat with a coupled cooling device to be able to easily alter the contact locations of the compressible pads with the wearer's forehead. To maintain comfort over long periods of time, it may be desirable to shift the contact locations on the wearer's forehead periodically. Example removable cooling devices can be located in a hat and positioned symmetrically about a midpoint of the wearer's forehead when the hat is worn. Example removable cooling devices are easily repositionable along the headband by sliding the complete removable cooling device (including clips 111*a* and 111*b* and thin flexible strip 113) along the hat headband. Alternatively or additionally, thin flexible strip 113 of removable cooling device 110 can slide back and forth within clips 111*a* and 111*b*. In some examples, compressible pads can be repositioned with respect to a thin flexible strip by using a repositionable adhesive or by using a repositionable fastening system such as a hook and look fastening system (shown in FIG. 5B). In some examples, individual compressible pads can be fixed to individual thin flexible strips that can be independently located along a hat headband with separate or integrated coupling structures, as shown in FIGS. 6A-6D, or may be mounted directly to removable coupling structures, as shown in FIG. 8, where the removable coupling structures can be easily moved along or slid on the headband to reposition the location of the compressible pad. Cooling device 110 can be completely removed from hat 100 and replaced at a different location along the headband 102. Any of the above examples allow the wearer to easily shift contact locations of compressible pads of the cooling system with the wearer's forehead. Any method known can be used to provide a removable cooling device with an ability to easily alter locations where compressible pads of the removable cooling device contact a wearer's head, and the invention is not limited to only those examples of repositioning disclosed in the examples.

Example removable cooling devices can be repeatedly coupled to and uncoupled from headband 102 of hat 100. Example removable cooling devices disclosed herein can be used with existing hats, and do not require any modification of the hat. Example removable cooling devices can be used with existing hats without modification. Removable cooling devices can be coupled to existing hats without the need to add buttons or buttonholes, male or female portions of snap fits or any parts of 2-part mechanical fasteners. Example cooling devices can be completely removed from hat 100 so hat 100 can be worn in an unaltered state when cooling is not needed, as may be the case in winter. By unaltered, it is meant that the hat is restored to its original condition prior to having ever been coupled to or used with an example removable cooling device. Completely removable cooling devices allow cooling devices to be easily removed for cleaning.

Example removable cooling devices space a portion of the headband of a hat away from a wearer's forehead creating an air gap between the headband and the wearer's forehead (or for example cooling devices that include a thin flexible strip, the air gap is formed between the thin flexible strip and the wearer's forehead), to provide a path for airflow over the user's forehead and head. Increasing the size of the gap improves the airflow and enhances cooling. Compressible pads 112*a* and 112*b* of cooling device 110 contact the wearer's forehead and provide spacing between the headband 102 (or thin flexible strip 113) and the wearer's forehead. Compressible pads are described in more detail with respect to FIG. 5A. As thickness of compressible pads increases, the size of the air gap increases, but compressible pads also stick out further from the headband making putting on and taking off the hat without disturbing the cooling device more difficult.

Thin flexible strip 113 is generally formed from a solid polymeric material such as polypropylene, polyethylene, polycarbonate, PET, PETG, or any other known thermoplastic, thermoset or elastomeric polymeric material capable of being formed into thin strips. The thin flexible strips are constructed to elastically deform to conform to the curvature of the headband of the hat when they are coupled to the hat. Alternatively, a thin flexible strip could also be formed from various metals such as aluminum, stainless steel, or other metals formable into thin sheets. However, it is generally more difficult to form thin metal strips without creating sharp edges that could potentially cut a wearer.

Thin flexible strip 113 elastically deforms conform to the shape of headband 102. The thin flexible strip acts as a soft spring and when conformed to the headband the spring force pushes the thin flexible strip against the headband helping to keep it in place. When fixed at one end, an opposite end of a thin flexible strip with width of 124 mm and a height of 20 mm oriented with the plane of the strip parallel to the ground deflects between 1 and 50 mm. A thin flexible strip sized as above that deflects more than 50 mm may be so soft that it could be damaged easily in use and may not have enough stiffness to adequately restrain the headband from falling into the air gap. A thin flexible strip sized as above that deflects less than 1 mm may be so stiff as to become difficult to use in practice. However, it should be understood that examples disclosed herein are not limited to having deflection characteristics that fit within the above limits, and softer or stiffer thin flexible strips may be useful in some cases.

The elastically deformable thin flexible strip also provides a beneficial substrate for mounting compressible pads 112. If a more rigid substrate were used (for example, as is the case for the example cooling device depicted in FIG. 8), forces applied to the wearer's head through compressible pads 112 could be concentrated into smaller areas which could potentially negatively impact comfort. The ability of the thin flexible strip to conform to the shape of the headband helps to evenly spread out applied compressive forces over the entire contact area of compressible pads 112 with the wearer's forehead.

When an example cooling device is installed in a traditional style baseball hat and the hat is pulled tight onto the wearer's head, the hat applies a force that pushes the pads against the wearer's forehead. Compressible pads 112 also locally push outward on the hat and can create externally visible distortions in the cap portion 105 above brim 101 of hat 100. The thin flexible strip 113 reduces the visibility of these distortions by spreading out applied forces over a larger area of the headband 102, making bulges in the cap portion 105 of hat 100 much less visible.

FIG. 3 depicts example cooling device 110 of FIG. 2A coupled to headband 102 of hat 100, though this is for convenience only as cooling device 110 could also be coupled to hat 100 with alternative methods such as the arrangement of coupling devices shown in FIG. 2B, or other methods not shown. Cooling device 110 is generally located symmetrically about centerline 120 of hat 100, though the wearer is free to adjust the location of cooling device 110 along headband 102 as they see fit to alter locations where pads 112*a* and 112*b* contact the wearer's forehead. Thin flexible strip 113 can be slid back and forth within clips 111*a* and 111*b* up to the point where one of compressible pads 112*a* or 112*b* contacts an edge of one of clips 111*a* or 111*b*. If clips 111 are also slid together with thin flexible strip 113 along headband 102, thin flexible strip 113 can be moved farther along headband 102. Methods for attaching cooling device 110 to headband 102 are described in more detail with respect to FIGS. 11A and B. In general, coupling structures are used to couple the cooling device to headband 102. The coupling structures may be separate parts such as clips 111, or they may be formed integral with thin flexible strip 113. Integrally formed coupling structures are described in more detail with respect to FIGS. 12A, 12B and 13. In all examples, coupling structures are arranged such that they do not directly contact the wearer's head.

In some examples, width 114 of thin flexible strip 113 is 124 mm, though the width of thin flexible strip 113 is not restricted to 124 mm and can be larger or smaller. In one non-limiting example described in more detail with respect to FIG. 6, the width of the thin flexible strip is substantially less than 124 mm, (in one non-limiting example the thin flexible strip of FIG. 6 is 55 mm wide). The thin flexible strip should not contact the wearer's head at any point, to avoid causing any irritation. Since the compressible pads are primarily responsible for creating the air gap between the hat headband (more specifically between the thin flexible strip which is attached to the headband) and the wearer's head, the amount the thin flexible strip extends beyond the outer bounds of the flexible pads should be no more than 45 mm. In some examples, the ends of the thin flexible strip extend 25 mm beyond outside ends of compressible pads fixed to the thin flexible strip. The thin flexible strip should extend beyond the outside ends of the compressible pads at least enough to accommodate a coupling structure for coupling the thin flexible strip to a hat headband, as shown in FIG. 2A. If the coupling structure has a width, the extension of the thin flexible strip beyond the outer bounds of the compressible pads is at least the width of the coupling structure, and preferably at least twice the width of the coupling structure, which reduces the chances of the thin flexible strip slipping out of the coupling structure inadvertently. In some examples, the coupling structures are 12 mm wide and the thin flexible strip extends 25 mm beyond the outer edge of the compressible pad.

In some examples, the thin flexible strip has a height 115 (shown in FIG. 2A). Generally, the height 115 should be less than or equal to the height of the headband 102. Since one function of the thin flexible strip is to keep headband 102 from falling into the air gap between the headband and the wearer's head created by the compressible pads, this aspect of performance is not changed if the height of the thin flexible strip extends beyond the height of the headband. Though one could extend the height of the thin flexible strip beyond the height of the headband if desired, doing so would require the height of the coupling structures to grow to accommodate the thin flexible strip. Since the cap section of a typical hat curves back toward the wearer's head, the coupling structures start to visibly deform the cap section 105 of hat 100 if they extend much beyond the headband. In some examples, the height of the thin flexible strip is less than or equal to 20 mm, and the height of coupling structures is less than or equal to 25 mm.

It is desirable to minimize the thickness of any materials that fill or protrude into the air gap created by the example cooling devices that do not directly contribute to forming the airgap. Since a large portion of the thin flexible strip 113 resides within the air gap but does not contribute to forming the air gap (the portion of thin flexible strip 113 other than where compressible pads are located), minimizing the thin flexible strip thickness helps maximize the resulting size of the air gap. The air gap and orientation of elements of example cooling devices are discussed in more detail with respect to FIGS. 9A-9B. Thickness 116 of thin flexible strip 113 (shown in FIG. 2A) is generally between 0.1 mm and 1.5 mm. In some embodiments, thickness 116 is between 0.2 and 0.5 mm. The thickness is chosen so that the thin flexible strip is sufficiently compliant so it can be elastically deformed to the shape of the headband but is stiff enough to keep the headband from falling into the air gap, as described earlier. A thin flexible strip that is too thick will not easily deform and a thin flexible strip that is too thin will not stay fixed against the headband sufficiently or may be too easily damaged. In one non-limiting example, the thin flexible strip is formed from polypropylene material that is approx. 0.3 mm thick. In one non-limiting example, the thin flexible strip is formed from PET material that is approx. 0.5 mm thick.

Figure 4:
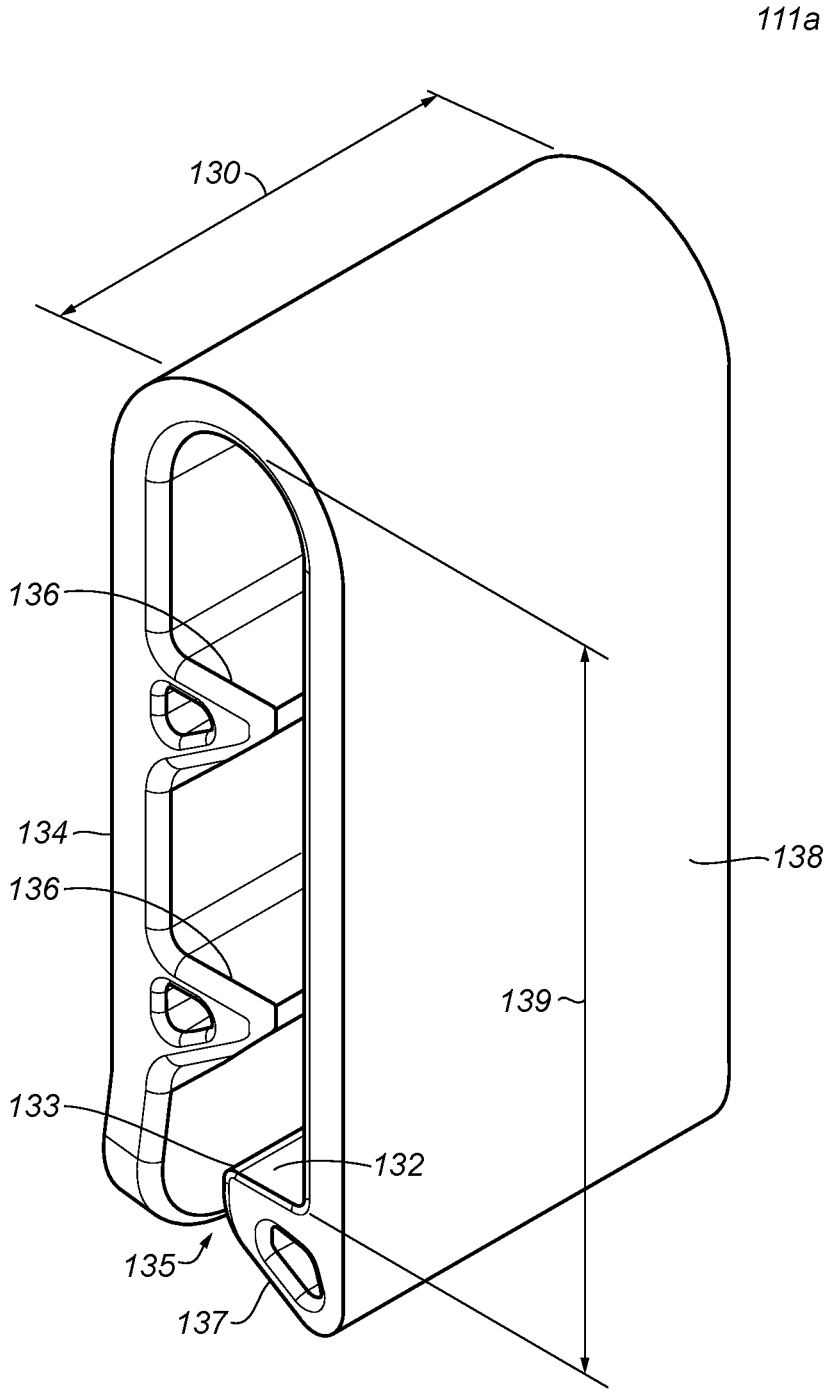
FIG. 4 is a perspective view of a separate coupling structure for use in coupling an example removable cooling device to a hat.

FIG. 4 depicts one example coupling device usable for coupling example removable cooling devices to a headband of a hat. FIG. 4 depicts a perspective view of clip 111*a*. Clip 111*a* fits over headband 102 so headband 102 sits within gap 135. The front wall 138 includes thin flexible strip retaining step 137. When clip 111*a* is coupled to headband 102, front wall 138 sits outside of headband 102 and faces the interior of cap portion 105 of hat 100. Step 137 protrudes away from the back side of front wall 138 into gap 135 and keeps the thin flexible strip from falling out of the bottom of clip 111*a* once it has been inserted fully into the clip. Gap height 139 is greater than the height 114 of thin flexible strip 113 so that thin flexible strip 113 can be fully inserted into clip 111*a*, with a bottom edge of the thin flexible strip 113 resting on retaining step 137.

Step 137 includes a flat horizontal surface 132 on which the thin flexible strip rests that terminates in sharp corner 133. Step 137 is shaped to provide less friction between the clip and the headband in a first direction of motion associated with inserting the clip onto the headband, and more friction with the headband in a second direction of motion associated with removing the clip from the headband. The bottom of step 137 curves away from the interior gap 135 in the region between sharp corner 133 and the bottom of front wall 138. This curved shape reduces friction between the headband and the clip when the clip is inserted onto the headband, while sharp corner 133 binds into the headband and increases friction between the clip and the headband when the clip is pulled off the headband.

Rear wall 134 rests between headband 102 and cap section 105. Friction enhancing structures 136 protrude from rear wall 134 into opening 135 of clip 111*a* and press against headband 102 when clip 111*a* is inserted onto headband 102. The friction enhancing structures act similarly to step 137 described earlier, with the exception that these structures do not need to provide a surface on which the thin flexible strip can rest. The bottom of the rear wall 134 is flared away from opening 135 so that the bottom of gap 135 is larger than the thickness of typical headband material. When inserting clip 111*a* onto headband 102, flare 134 allows the clip to be easily started. While the bottom of front wall 138 could be flared, this would cause the bottom of the front wall to protrude farther towards the wearer's head. As will be described later, it is desirable to reduce the thickness of elements other than the compressible pads that protrude towards the wearer's head, to minimize the chance of contact with the wearer's head, and to avoid blocking more of the air gap.

Clip 111*a* has a width 130. As described previously, when cooling device 110 is fixed to hat 100, at least two coupling structures are used. FIGS. 2A and 2B depict two non-limiting options for locations of coupling structures relative to compressible pads that are fixed to a thin flexible strip. Coupling structures are either located outboard of or inboard of the compressible pads.

It is possible to use more than two coupling structures. For example, a first pair of coupling structures may be arranged as shown in FIG. 2A, and a $3^{rd}$ coupling structure may be located between the pair of compressible pads 112*a* and 112*b* of example removable cooling device 110. In this example, the compressible pads need only be spaced apart by at least the width of one coupling structure, while ends of the thin flexible strip need to extend beyond outer ends of compressible pads as described earlier.

If it is desired to allow adjustment of a thin flexible strip by sliding it back and forth within the coupling structures, the coupling structures should be placed onto the headband in locations that are spaced away from side ends of compressible pads by the amount of sliding adjustment distance desired, to allow sliding motion of the thin flexible strip along the headband.

In some examples, the coupling structures are spring clips. The front and rear walls of clips are separated slightly when the clips are inserted onto the headband so that some spring force is applied to aid in holding the clips in place.

In some examples, the width of coupling structures is generally less than 25 mm. Since hats are formed in a curved shape to wrap around the wearer's head, clips wider than 25 mm will more easily form visible distortions in the cap section. The mechanical requirements of the clips are minimal as only a small force is required to keep the thin flexible strips in place. This allows substantially narrower clips to be used. In some examples, coupling structures may be anywhere between 3 mm and 25 mm wide. In one non-limiting example, coupling structures are 12 mm wide. In one example, 12 mm wide clips with friction modifying features and a thin flexible strip retaining step are injection molded from Dupont Delrin thermoplastic material, though a wide range of other polymer materials (e.g. polypropylene, nylon, ABS, or any other thermoplastic polymer) could be used and examples disclosed herein are not limited in the materials used for coupling structures.

If a wider coupling structure is used, some curvature can be added to the structure, or to at least the rear facing wall of the structure, to more closely follow the curvature of the front of the hat, to reduce visibility of the structure edges forced into the hat material. In general, the radius of curvature of a hat in the brim area is approx. 100 mm. A reasonable limit is to have the width of a coupling structure be less than 2% of the circumference, which in this case would have the clips be less than about 12 mm.

It is beneficial to locate cooling structures in regions of a hat that have sufficient stiffness to retain their shape when they are spaced away from the wearer's head. This keeps the hat from deforming locally around locations of the compressible pads and sealing off the air gap. The bill or brim on baseball style caps provide such stiffness, but other hats also have sufficient stiffness to retain their shape. Use of the thin flexible strip can also help to maintain an air gap if a hat does not have sufficient stiffness to retain its shape.

Figure 9A:
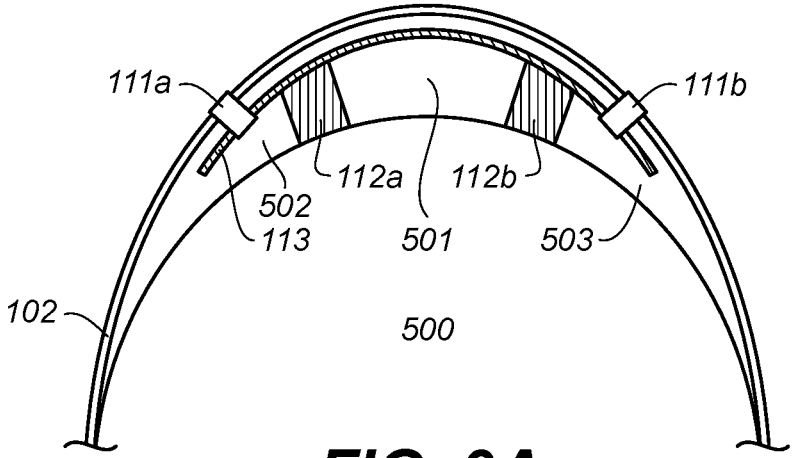
FIG. 9 is top view of the example removable cooling device of FIG. 2A installed in a hat and worn by a wearer.
FIG. 9B is top view of the example removable cooling device of FIG. B installed in a hat and worn by a wearer.
FIG. 9C is top view of the example removable cooling device of FIG. 2A including a sweatband installed in a hat and worn by a wearer.
Figure 9B:
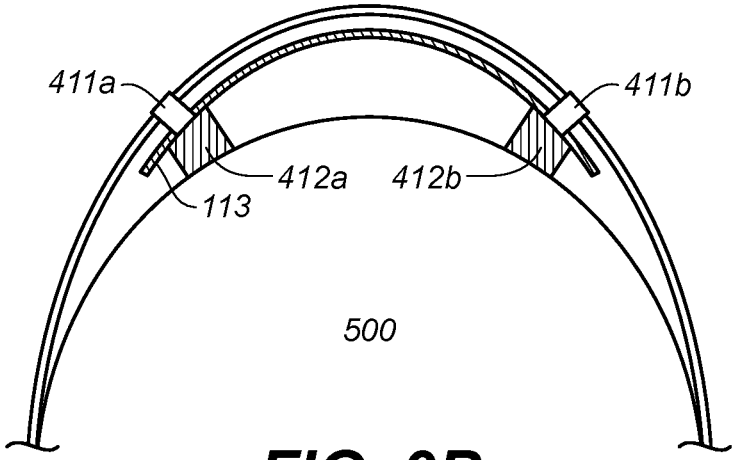

For example removable cooling devices where the coupling structures do not sit directly underneath a compressible pad (examples where coupling structures sit underneath compressible pads are described later and are shown in FIGS. 8 and 9B), the thickness of the portion of the coupling structure that sits between the thin flexible strip and the wearer's head must at least be less than the thickness of the compressible pads. Since the thicknesses of the compressible pads decrease when they are pressed against the wearer's forehead, the thicknesses of the portions of the coupling structures sitting between the thin flexible strip and the wearer's head should be less than the compressed thicknesses of the compressible pads. Because the compliance of pads can vary and wearers also alter how tightly they wear their hat, it is difficult to say exactly how much the compressible pads compress in use. However, since the function of the compressible pads is to create an air gap, they must retain some thickness, even when hats are tightly worn. It also becomes difficult to put on and take off the hat if the compressible pads grow too thick, which implies the difference between uncompressed and compressed thickness should not be too great. Generally, it has been found that it is sufficient if the portion of the coupling structure sitting between the thin flexible strip and the wearer's head is less than ½ the uncompressed thickness of the compressible pad. For coupling structures located outboard of compressible pads, as the coupling structures move farther away from the pads their allowable thickness decreases as the air gap thickness reduces with distance from the pads. This is shown in more detail in FIGS. 9A-9C. It should also be noted that apart from avoiding having the coupling structures contact the wearer's head, since the portion of the coupling structures that sit between the thin flexible strip and the wearer's head protrude into and take up space within the air gap, their thickness should be minimized to minimize restriction of air flow through the air gap.

It is desirable for example removable cooling devices to be able to be repeatedly coupled to and uncoupled from hats without substantive degradation of the ability of coupling structures to hold example removable cooling devices in place against the headband of the hat. By substantive degradation, it is meant that holding forces applied by coupling structures to hold removable cooling devices in place do not degrade by more than 20% after 25 cycles of coupling to and uncoupling from a hat. In some examples, mechanical properties of the coupling structure, for example the spring constant of the coupling structure, change less than 20% after 25 cycles of insertion and complete removal of the removable cooling device from the headband. Preferably, after 25 cycles of insertion and complete removal, holding forces degrade by less than 5%. Preferably, after 25 cycles of insertion and complete removal, the mechanical properties of the coupling structures change by less than 5%.

Spring clips are one non-limiting example of a coupling structure for use with the example removable cooing devices disclosed herein that can provide this capability. Spring clips can be used over and over without degradation of the inherent spring constant as long as the clips are not opened excessively to the point where there is plastic deformation of the clip material. Spring clip coupling structures are constructed so that opening the spring clip sufficiently to allow the coupling structure to easily slide over the headband does not exceed the elastic limit of the spring clip.

Other coupling methods such adhesives degrade rapidly with multiple cycles of coupling and uncoupling, especially when bonding to fabric materials where micro-fibers remain adhered to the adhesive reducing bond strength on subsequent uses. Spring clips are preferrable to other mechanical fasteners such 2-part fasteners like buttons, snaps or hook and loop fasteners, as these mechanical fasteners require permanent modification of the hat headband (adding a button or buttonhole, fastening either a male or female snap portion to the headband, or permanently fixing either the hook or loop portion of the hook and loop fastener to the headband). Other coupling methods such as pins are undesirable as the thickness of the coupling structure increases making visible distortions of the hat more likely, and it is undesirable to have sharp elements close to the wearer's head. Magnetic fasteners have difficulty providing sufficient holding force in hats that have thicker headbands.

The stiffness of an example spring clip used to couple removable cooling devices to a hat headband should be low enough to allow the spring clip to be opened so it can be inserted onto the hat headband, yet still provide sufficient holding force to keep the spring clips in place once they are located on the headband. Example spring clips should be modified in some manner to increase the coefficient of friction between the example spring clip and the headband. In some examples, the surfaces of the example spring clip that contact the headband are modified to increase their coefficient of friction with the headband. In some examples, the surface finish is modified to increase sliding friction. In some examples, a high friction coating is applied to surfaces of the spring clip that contact the headband. In some examples, friction modifying protruding structures are added to surfaces that contact the headband, to locally increase pressure against and friction with the headband. In some examples, various combinations of friction enhancing modifications are used.

In some examples, friction for motion in the direction associated with inserting the coupling structure onto the headband is lower than friction for motion of the coupling structure in the direction associated with removing the coupling structure from the headband. Friction for a direction of motion associated with sliding the coupling structure laterally along the headband is lower than friction in a direction of motion associated with removing the coupling structure from the headband.

In some examples, friction modifying structures alter friction differently for different degrees of freedom of motion of the coupling structure relative to the headband. Friction between the coupling structure and the headband for a first degree of freedom of motion is different than friction in a second degree of freedom of motion. Friction for motion in a direction laterally along the headband may be lower than friction for motion in a direction of removing the coupling structure from the headband.

The spring force applied by a spring clip is primarily responsible for coupling example removable cooling devices in place against a headband of a hat. As long as forces applied to the spring clip to insert and remove it from the headband result in an applied stress that is lower than the elastic limit of the spring material, the spring force should not substantively degrade. Preferably, the applied stress should be kept below 80% of the elastic limit of the material, and more preferrable below 50% of the elastic limit. In such cases, the spring force of a spring clip used to couple a removable cooling device to a headband of a hat should change less than a few percent over 25 cycles of insertion and complete removal and may change less than a few percent over a substantially greater number of cycles.

Figure 5A:
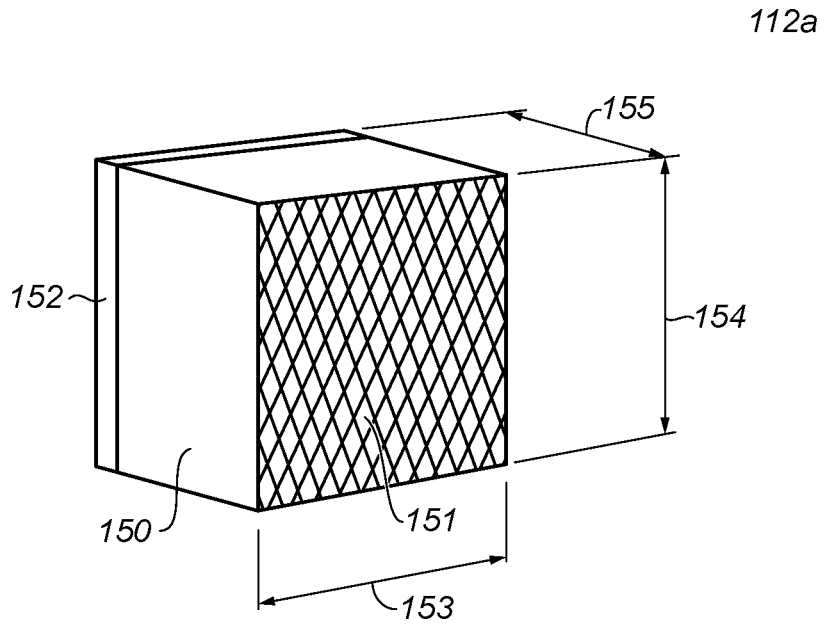
FIG. 5A is a perspective view of a compressible pad component of a removable cooling device for a hat.

Depicted in FIG. 5A is one non-limiting example of compressible pad 112*a*. Example cooling devices provide compressible pads that space the hat headband away from the wearer's head, and more specifically the wearer's forehead. Simultaneously, compressible pads (vs. hard spacers) provide improved comfort when the contact area of the hat with the user's forehead is reduced (as must be the case when a gap is formed). In some examples, the compressible pads are coupled to a thin, flexible strip. The thin flexible strip provides a beneficial surface for fixing compressible pads. Thin flexible strips can also hold the headband of the hat in place and keep it from bulging out and blocking the air gap, especially when the headband is made from a thin fabric material.

Pad 112*a* includes open cell foam material 150, coupling layer 152 and moisture wicking fabric top layer 151. In some examples, coupling layer 152 is a pressure sensitive adhesive layer which may permanently bond or repositionably bond to a substrate, such as a thin flexible strip. IN some examples, coupling layer 152 may be part of a 2-part fastening system, such as a hook and loop fastener. Moisture wicking top fabric layer 151 pulls perspiration away from the skin, improving comfort. It has been found that having any conventional fabric layer between the foam and the wearer's skin improves long term comfort, with moisture wicking having the added benefit of helping to keep the area directly under the compressible pads from staying perpetually moist. In some examples, top fabric layer is woven nylon. Nylon is also beneficial because it is oleophobic so it will also not hold onto odors over time, while also providing good moisture wicking performance.

Open cell foam 150 is compressible and provides cushioning when pads are pressed against a wearer's head. Preferably open cell foam 150 is also moisture wicking to help pull moisture away from the fabric top layer 151. Since the foam is open cell, air can pass through it and moisture that wicks into the foam can be evaporated. In some examples, open cell foam 150 is polyurethane foam. Various treatments are possible to enhance properties of the foam. For example, carbon black may be added to the foam as both a colorant and to reduce odors. Carbon black also provides protection against UV exposure. A hydrophobic coating may be applied to keep the compressible pad from retaining moisture and to promote evaporation. Oleophobic coatings may be applied to reduce absorption of oils, which can also reduce odors. Anti-microbial coatings may also be applied to prevent growth of odor causing microbes. Various coatings can be used in combination.

The process for fixing the top fabric layer to the foam should not seal the fabric and should not block pores on the surface of the foam. In general, a thermal bonding process can be used to adhere a polymer fabric such as a nylon woven fabric to an open cell foam material (for example a polyurethane foam). It should also be noted that use of a fabric top layer is not required and a removable cooling device may use compressible pads that do not include a fabric top layer, but use of a fabric layer has been found to improve comfort.

The compressible pads with fabric top layer are preferably dark or black in color. Since the removable cooling device spaces the hat away from the wearer's head, making the removable cooling device a dark color minimizes its visibility while it is being worn. In some examples, a polyurethane open cell foam has carbon black material added to color the foam black.

Compressible pad 112*a* has width 153, height 154 and thickness 155. Though pad 112*a* is shown in FIG. 5A as being rectangular in shape, example cooling devices are not limited in the shapes of the compressible pads. Compressible pads are arranged to rest against the wearer's forehead. There is a tradeoff between physical comfort parameters and cooling benefit. To maximize cooling, it is desirable to minimize the projected planar contact area of the compressible pads with the wearer's forehead. The pads will block less of the air gap and will cover less skin area on the wearer's forehead, both of which act to improve cooling behavior obtained as more air can flow over a larger skin surface area. However, reducing the contact area necessarily increases the pressure applied to the wearer's forehead over the contact area, for a given holding force applied to hold the hat in place. As this pressure increases, mechanical comfort is reduced.

It has been found empirically that the total projected planar surface contact area of compressible pads on the wearer's forehead should be greater than 400 sq mm. If the projected planar surface contact area is less than this, the applied pressure may become uncomfortable for some wearers. It has also been found that when the projected planar surface contact area is greater than 2000 sq mm the cooling benefit may be reduced as the compressible pads take up a larger portion of the air gap and cover a larger area of the wearer's head. In general, it is desirable to keep the projected planar surface contact area as small as possible for improved cooling, without becoming uncomfortable. In some examples, a removable cooling device includes a pair of compressible pads, where each pad is 20 mm wide by 18 mm high, where the example removable cooling device has a projected planar surface contact area with the wearer's forehead of 720 sq mm.

It has been found for example removable cooling devices that include a pair of compressible pads, the pad spacing should be between 10 mm and 120 mm, though examples are not limited to these spacings. It has been found that spacings of a single pair of compressible pads greater than about 60 mm start to become less effective in creating an air gap in the front of the hat between the hat and the wearer's forehead because the pads have moved around to the sides of the hat somewhat. In general, once pad spacing grows larger than 60 mm, it has been found to be beneficial, though not required, to include a 3rd compressible pad that is centered between the first pair of compressible pads as shown in FIG. 10. Such an arrangement increases the air gap around the sides of the head while the centrally located pad maintains the air gap in the front of the hat. When a centrally mounted third compressible pad is used, spacing between the first pair of pads can grow beyond 60 mm if desired. In some examples having three compressible pads, it has been found that the outside pair of pads can be spaced apart by up to 120 mm. In arrangements with three or more compressible pads, it has been found to be beneficial for the outside pads to have a different thickness than the more centrally mounted pad or pads.

It has also been found empirically that an air gap should be at least 5 mm between the wearer's head and the hat headband. Air gaps smaller than this do not allow enough air flow to provide useful cooling benefit. Making the air gap larger beneficially increases air flow and cooling effect. However, there is a practical limit to the thickness of pads that can be used. First, as the thickness of compressible pads is increased to increase the size of the air gap, the hat size may need to be adjusted to accommodate the increased space. The amount the hat size can be increased is limited by the size adjustment range of the hat. Wearer's with larger than average head sizes may already use most of the size adjustment range to accommodate their head leaving a limited amount of size adjustment to accommodate the air gap. If the compressible pads are made too thick, wearer's with larger head sizes may not be able to adjust the hat so that they can wear it.

Additionally, it has been found empirically that pad thicknesses greater than 25 mm make it difficult for wearers to put on and take off the hat. As the pad thickness increases, the pads stick out further to the point that the cooling apparatus can be moved or knocked loose when trying to put on or take off the hat. While larger air gaps continue to provide increased cooling benefit, practical considerations of the range of hat size adjustment and ease of putting on and taking off the hat constrain desirable ranges of pad thickness. It should be noted, though, that the examples disclosed herein are not limited in the thickness of compressible pads used. In some examples, the compressed pad thickness obtained when the cooling device is installed in a hat and the hat is worn should be greater than 5 mm, and the uncompressed thickness should be less than 25 mm. In one non-limiting example, the uncompressed pad thickness is 15 mm and the compressed pad thickness is approx. 7 mm. It should be understood that compressed pad thickness is in part a function of how tightly the hat is worn and is therefore not a fixed value. At the point where the hat first becomes uncomfortably tight to wear, the compressed thickness of the compressible pads should be greater than 5 mm.

In some examples, a stiffer compressible pad may used. A stiffer compressible pad may have an uncompressed thickness that is closer to a final desired gap thickness. For example, if the desired air gap thickness is 10 mm, a compressible pad whose thickness decreases by 50% when worn would need an uncompressed thickness of 20 mm, whereas a compressible pad whose thickness only changes by 10% when worn would have an uncompressed thickness of 11.1 mm. Because the uncompressed thickness is less, these stiffer compressible pads would see less interference when the hat is put on and taken off, for the same resulting air gap. However, the stiffness of the compressible pads also affects comfort, where more compressible pads are generally more comfortable.

The compressible pads are effectively placing a spring between the hat headband and the wearer's head. The stiffness of this spring affects the relationship between the hat size adjustment and the applied pressure to the wearer's head. The softer this spring, the less the applied pressure changes with the change in hat size. This makes it easier to find a comfortable setting for hat size, though it reduces the amount of adjustment available to accommodate variation in head size.

Figure 5B:
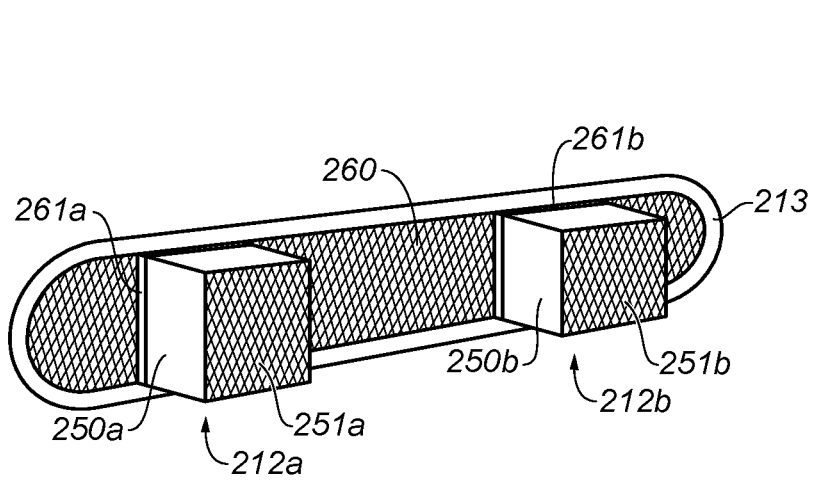
FIG. 5B is a perspective view of one example of a removable cooling device for a hat having repositionable compressible pads.

FIG. 5B shows example removable cooling device 200 which uses a 2-part fastening system to couple compressible pads to the thin flexible strip. Affixed to thin flexible strip 213 is first part 260 of a hook and loop fastening system. First part 260 is permanently bonded to thin flexible strip 213 with a permanent adhesive. First part 260 is located along the thin flexible strip wherever it is desired to be able to locate a compressible pad. Compressible pads 212*a* and 212*b* include open cell foam 250*a* and 250*b* and top fabric layers 251*a* and 251*b*. Permanently attached to rear sides of foam 250*a* and 250*b* are second parts of the hook and loop fastening system 261*a* and 261*b*. The 2-part hook and loop fastening system allows pads 212*a* and 212*b* to be removed from thin flexible strip 213 and relocated as desired. In some examples the thinner part of the 2-part fastening system is affixed to the thin flexible strip and the thicker part is attached to the compressible pad. Since the portion of the part affixed to the thin flexible strip that does not have a compressible pad attached sits within the air gap, minimizing this thickness maximizes the air gap. In general, the loop portion of hook and loop fasteners is thinner that the hook portion.

Figure 12A:
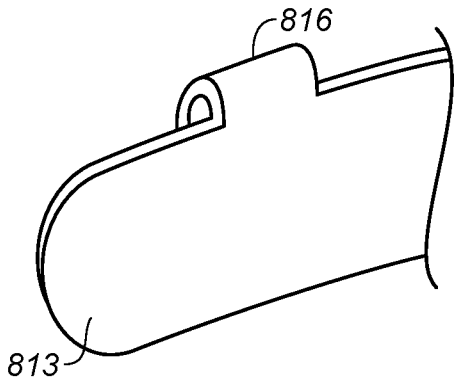
FIG. 12A is a front perspective view of a portion of one example of a removable cooling device for a hat having an integrally formed coupling structure.
Figure 12B:
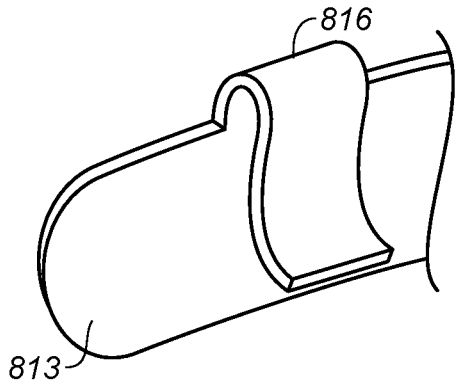
FIG. 12B is a rear perspective view of the portion of an example removable cooling device for a hat of FIG. 12A.
Figure 13:
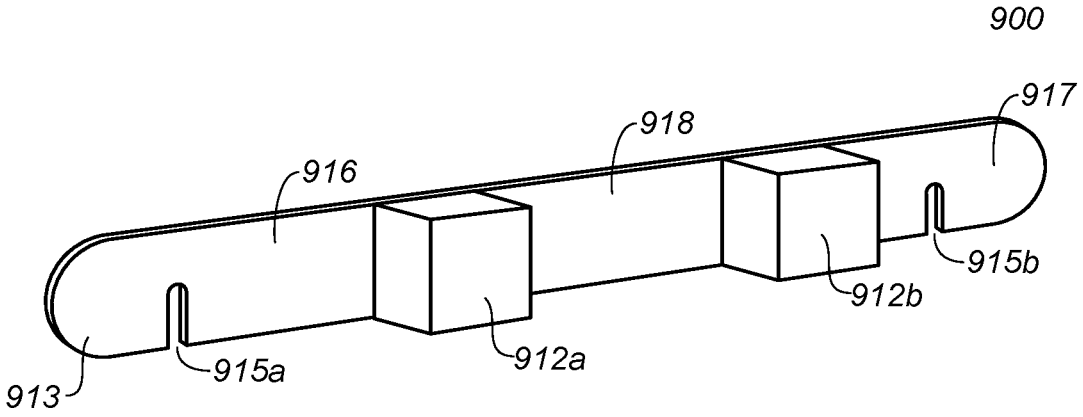
FIG. 13 is a front perspective view of one example of a removable cooling device for a hat having an integrally formed coupling structure

Separate coupling structures as shown in FIGS. 2A and 2B can be used with example removable cooling device 200 or coupling structures can be integrally formed as part of thin flexible strip 213 (as shown in FIGS. 12A, 12B and 13). The first part of the hook and loop fastener as shown does not extend all the way to the ends of the thin flexible strip. This provides room to fit separate coupling structures such as clips 111*a* and 111*b*. It is also possible to place coupling structures as shown in FIG. 2B, though these structures will have to fit over both thin flexible strip 213 and the first part of hook and loop fastening system 260.

Figure 6A:
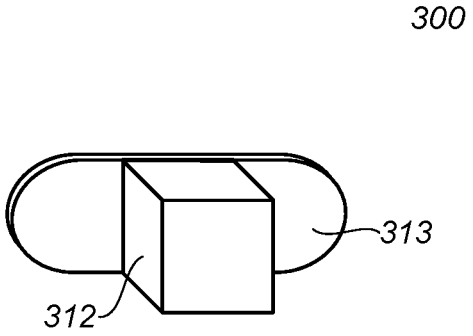
FIG. 6A depicts one example of a removable cooling device for a hat having a single compressible pad.

FIG. 6A depicts another non-limiting example of a removable cooling device for a hat. Removable cooling device 300 includes thin flexible strip 313 and compressible pad 312. Example removable device 300 shows only a single compressible pad. In general, a wearer could use a single removable cooling device 300 in a hat but preferably would install at least two of the removable cooling devices 300 simultaneously in a single hat. This arrangement can produce an air gap in the same manner as described for other example cooling devices disclosed herein that incorporate at least a pair of compressible pads. Each removable cooling device 300 is coupled to the headband of a hat using either separate coupling structures, for example a pair of clips 111*a* and 111*b* (though other separate coupling structures may also be used) or integrally formed coupling structures as shown in FIGS. 12A, 12B and 13 (though other integrated coupling structures may also be used).

The ends of the thin flexible strip 313 can be extended beyond the outer ends of compressible pad 312 to help keep the hat headband from falling into the air gap formed by the compressible pad. This extending of the width of the thin flexible strip can be independent of the choice of coupling structure used (separate or integral). The extension beyond the outer ends of the compressible pad may be symmetric or asymmetric.

In the example of FIG. 6A, thin flexible strip 313 is shown as extending beyond outside ends of compressible pad 312 a sufficient distance to allow separate coupling structures to couple these portions of the thin flexible strip to the headband of a hat. It should be understood that if integral coupling structures are used, the ends of thin flexible strip 313 need not extend beyond the outside ends of compressible pad 312, may extend a short distance insufficient to accommodate a separate coupling structure, may extend only to one side and not the other, or may extend a distance beyond one or the other or both outside ends of the compressible pad to keep the headband from falling into the air gap.

Figure 6B:
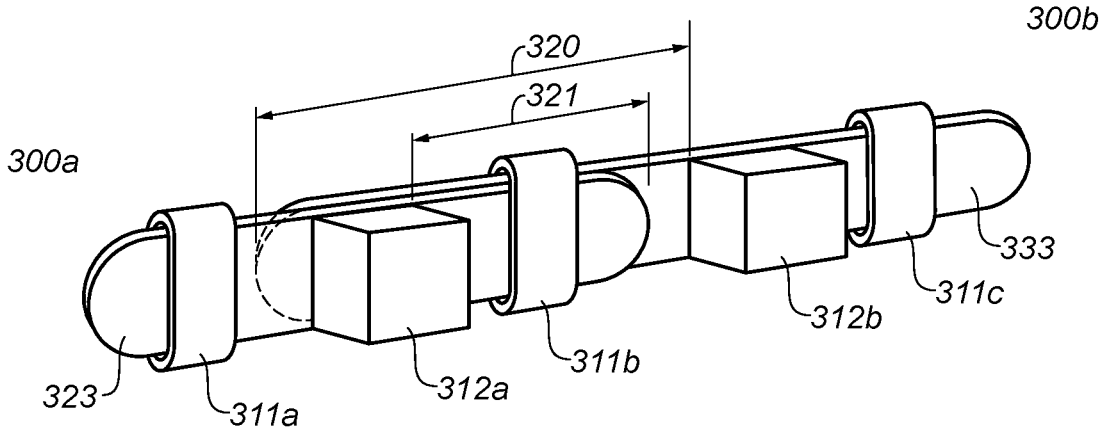
FIG. 6B is perspective view of an arrangement of a pair of removable cooling devices for a hat, arranged so that they can slide relative to each other.

FIG. 6B shows one non-limiting example coupling a pair of removable cooling devices 300*a* and 300*b* (similar to device 300 of FIG. 6A) to a headband using three separate coupling structures, rather than four. Device 300*a* includes thin flexible strip 323 on which compressible pad 312*a* is attached, and device 300*b* includes thin flexible strip 333 on which compressible pad 312*b* is attached. Coupling structure 311*a* couples device 300*a* to the headband of a hat. Coupling device 311*b* couples both of devices 300*a* and 300*b* simultaneously to the hat headband. Coupling device 311*c* couples device 300*b* to the hat headband.

Device 300*a* can slide back and forth within coupling structures 311*a* and 311*b* relative to device 300*b*, thereby altering the spacing between compressible pads 312*a* and 312*b*. Device 300*b* can slide back and forth within coupling structures 311*b* and 311*c* relative to device 300*a*, thereby altering the spacing between compressible pads 312*a* and 312*b*. To accommodate a wider range of relative spacing of compressible pads, one of thin flexible strips 323 and 333 may be longer than the other. The end of one of the thin flexible strips extending beyond its attached compressible pad in the direction towards the other removable cooling device mat be longer than the end of the other thin flexible strip that extends towards the first removable cooling device. In the example of FIG. 6B, distance 320 is larger than distance 321, though in other examples the distances can be equal if desired. In one non-limiting example, distance 320 is 40 mm and distance 321 is 20 mm. This provides a minimum spacing of 20 mm and an approximate maximum spacing of 40 mm (with some margin to keep thin flexible strips from slipping out of clips 311, using clips with a 12 mm width). Of course, if one wishes to add a fourth coupling structure, then devices 300*a* and 300*b* can be separated as much as desired.

In some examples, more than two removable cooling devices like device 300 may be used simultaneously in a hat. These devices can use any of the coupling methods described elsewhere to couple the thin flexible strips to the headband of a hat. As noted earlier, when more than two removable cooling devices are used in a single hat, the compressible pads need not all have the same thickness. The thin flexible strips also need not be the same width. For example, a centrally located removable cooling device may have a thin flexible strip with ends that extend beyond the outer sides of the compressible pad fixed to it a substantially greater amount than is done for either of the removable cooling devices located to the sides of the centrally located device. Alternatively, each of the devices to the sides may have one end of the thin flexible strip that extends substantially farther past the outer sides of the respective attached compressible pad than is the case for the more centrally located removable cooling device.

Figure 6C:
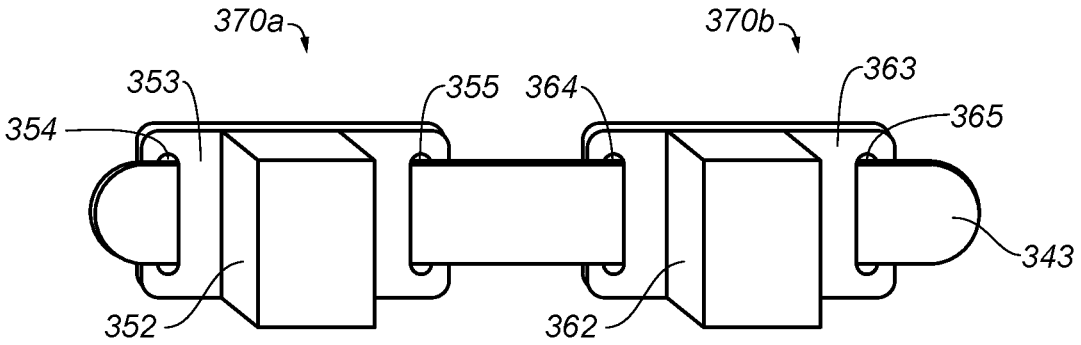
FIG. 6C is a perspective view of one example of a removable cooling device for a hat having repositionable compressible pads.

FIG. 6C depicts one example of a removable cooling device using intercoupled thin flexible strips to achieve repositionable compressible pads. Though this example shows a pair of thin flexible strips with compressible pads intercoupled and slideable relative to a third thin flexible strip, other configurations of interlocking or intercoupling and relatively slideable thin flexible strips with compressible pads are contemplated herein and examples are not limited to the configuration of intercoupled and relatively slideable thin flexible strips depicted in FIG. 6C.

Assemblies 370*a* and 370*b* include compressible pads 352 and 362 which are mounted onto thin flexible strips 353 and 363 respectively. Thin flexible strip 353 has slots 354 and 355 formed on either side of compressible pad 352. Thin flexible strip 363 has slots 364 and 365 formed on either side of compressible pad 362. Thin flexible strip 343 feeds through slots 354, 355, 364 and 365. Assemblies 370*a* and 370*b* which include compressible pads 352 and 362 are intercoupled with and are repositionable along thin flexible strip 343 by sliding thin flexible strips 353 and 363 along thin flexible strip 343. In some examples, coupling structures (not shown in FIG. 6C) such as clips 111*a* and 111*b* could be used to couple ends of thin flexible strip 343 to a hat headband. Alternatively, coupling structures could couple thin flexible strips 353 and 363 to a hat headband. In some examples, coupling structures are formed integrally with thin flexible strip 343. In some examples, coupling structures are integrally formed with thin flexible strips 353 and 363. It should also be noted that FIG. 6C depicts two compressible pads mounted on thin flexible strips but examples are not limited in the number of repositionable compressible pads used.

Figure 6D:
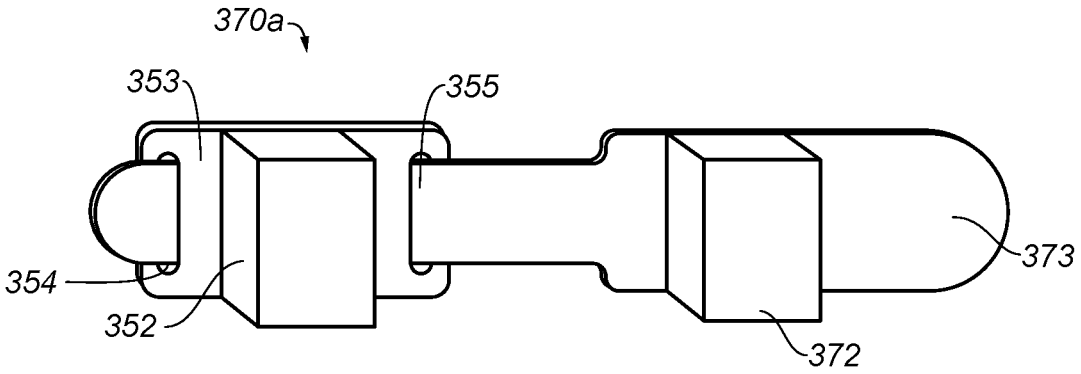
FIG. 6D is a perspective view of one example of a removable cooling device for a hat having repositionable compressible pads.

FIG. 6D depicts another example with intercoupled and relatively slideable thin flexible strips. Assembly 370*a* fits onto and intercouples with thin flexible strip 373 and can slide along the narrower section of thin flexible strip 373. Thin flexible strip 373 has compressible pad 372 attached. The narrower portion of thin flexible strip 373 fits into slots 354 and 355 of assembly 370*a*. It should be noted that though slots 354 and 355 are depicted as being located on either side of compressible pad 352, both slots could be on the same side of compressible pad 352. When assembly 370*a* slides along the narrower portion of thin flexible strip 373, the relative spacing between compressible pads 352 and 372 is adjusted.

Figure 7:
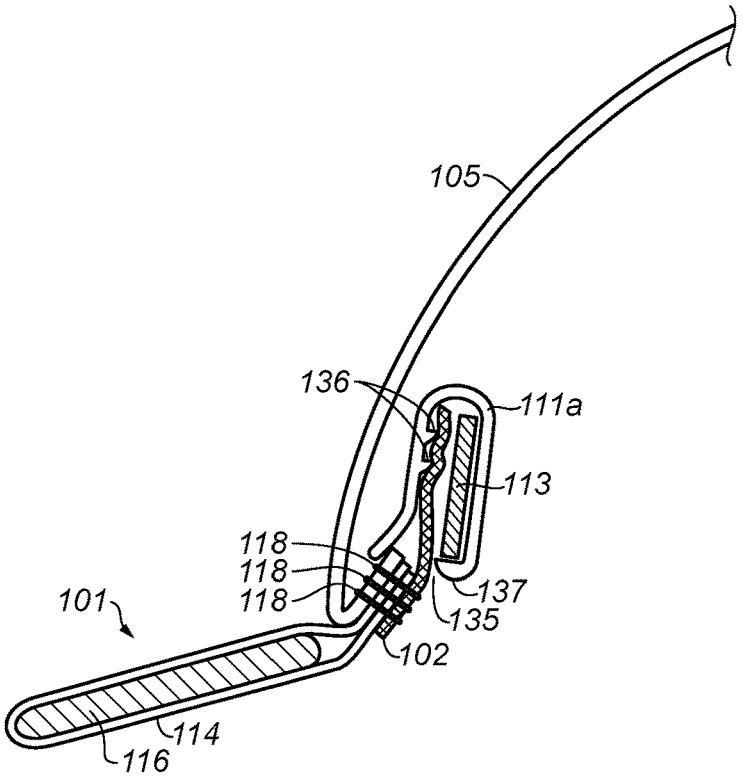
FIG. 7 is a section view of a portion of a hat with a removable cooling device coupled to the hat headband, taken through a coupling structure used to couple the removable cooling device to the hat headband.

FIG. 7 depicts cross section A-A of FIG. 3 which is taken through coupling structure 111*a*. Sitting within gap area 135 of clip 111*a* are headband 102 and thin flexible strip 113. Retaining step 137 and friction enhancing structures protrude into gap 135 and press on and dig into headband 102, causing it to bend around and be compressed in regions by the structures. Thin flexible strip 113 can slide laterally along the headband (which in this view would be in or out of the plane of the paper) but is constrained from moving vertically by retaining step 137 and the curved top section of clip 111*a*. Brim 101 includes internal stiffener 116 which is wrapped with a fabric covering 114. Ends of fabric covering 114 are stitched to cap portion 105 and headband 102 with stitching 118.

FIG. 8 depicts one non-limiting example of a removable cooling device 400 including compressible pad 412 affixed to coupling structure 411 with adhesive layer 452. As shown, coupling structure 411 is similar to earlier described clips 111*a* and 111*b*. Compressible pad 412 is similar to earlier described compressible pads 112*a* and 112*b*. A wearer may place one or more devices 400 into a hat simultaneously. Removable cooling devices 400 can easily be inserted into and removed from hats without degradation of the holding force of coupling structures 411. Devices 400 can slide laterally along headband 102 so a wearer can easily adjust locations where compressible pads 412 contact the wearer's head. Removable cooling devices 400 can be used with or without a thin flexible strip. If a thin flexible strip is used, it should be used with two or more removable cooling devices 400 to securely couple it to the headband of the hat. When compressible pads are affixed to coupling structures used with a thin flexible strip, the contact locations of the compressible pads with the wearer's head can easily be adjusted without needing to move or adjust the thin flexible strip. The relative spacing as well as contact locations with the head can be easily altered.

In some examples, width 453 of the compressible pad 412 is larger than a width 430 of the coupling structure 411, so that the compressible pad 412 hangs over sides of the coupling structure 411. This helps to reduce any discomfort that may arise from an end of the coupling structure when the compressible pad is pressed against the wearer's head (as the coupling structure is more rigid than the thin flexible strip).

In one example, a thin flexible strip such as thin flexible strip 113 is coupled to a headband of a hat with at least a pair of coupling structures. The coupling structures may be separate coupling structures such as clips 111*a* and 111*b*, or they may be formed integrally with the thin flexible strip as shown in FIGS. 12A, 12B and 13. One or more devices such as device 400 of FIG. 8 having a separate coupling structure with an attached compressible pad can be coupled to the thin flexible strip (as opposed to being coupled to the headband directly). The devices 400 can be slid onto thin flexible strip before it is coupled to the headband or they can be snapped onto the thin flexible strip after it is in place and coupled to the headband. Sliding a device 400 along a thin flexible strip allows its location relative to a wearer's head to be easily adjusted by a wearer, while avoiding the potential for the device 400 to come loose from the headband which can occur when devices 400 are directly coupled to a headband.

FIGS. 9 A-C depict top views of various example removable cooling devices coupled to a headband of a hat. Referring to FIG. 9A, removable cooling 110 device of FIG. 2A is shown in a top view attached to headband 102 of hat 100 of FIG. 1. In this view, brim 101 and cap portion 104 of hat 100 are not shown. Compressible pads 112*a* and 112*b* contact wearer's head 500 at two locations which spaces thin flexible strip 113 away from the wearer's head 500. Thin flexible strip 113 is coupled to headband 102 with clips 111*a* and 111*b*. Air gap 501 is formed between compressible pads 112*a* and 112*b*, and between thin flexible strip 113 and the wearer's head 500. Thin flexible strip 113 keeps headband 102 from falling into air gap 501. Air gap 502 sits to the left of compressible pad 112*a*, and air gap 503 sits to the right of compressible pad 112*b*. Outside of compressible pads 112*a* and 112*b*, the spacing between headband of hat 100 and wearer's head 500 gradually decreases until the hat headband touches the wearer's head and closes off the air gaps 502 and 503. Portions of clips 111*a* and 111*b* sit in the region between thin flexible strip 113 and the wearer's head 500. These portions take up some volume within the air gap and may slightly reduce air flow, depending on their thickness relative to the thickness of the air gap. As described previously, it is desirable for the thickness of these portions of the coupling structures to be kept small so as not to negatively impede air flow through the air gaps.

It can also be seen that clips 111*a* and 111*b* will become larger and larger portions of gaps 502 and 503 as they are moved farther outboard, and at some distance they may make contact with wearer's head 500 (if thin flexible strip 113 is extended far enough beyond compressible pads 112*a* and 112*b*). Though not shown in this top view, the arrangement of elements shown in FIG. 2B places clips 111*a* and 11*b* in between compressible pads 112*a* and 112*b*. Clips 111*a* and 111*b* can be located anywhere in between compressible pads 112*a* and 112*b* without risk of contacting the wearer's head (as long as the compressed thickness of the compressible pads is greater than the thickness of the portion of clips 111*a* and 111*b* that sit within the air gap).

FIG. 9B depicts two removable cooling devices similar to device 400 of FIG. 8 and a separate thin flexible strip coupled to headband 102 of hat 100. Compressible pads 412*a* and 412*b* are affixed to coupling structures 411*a* and 411*b*. Coupling structures 411*a* and 411*b* are coupled to headband 102. Coupling structures 411*a* and 411*b* also retain thin flexible strip 113 in place against headband 102. In this arrangement, the portions of coupling structures 411*a* and 411*b* that sit between the thin flexible strip and the wearer's head act as part of the elements that space the thin flexible strip away which is against the headband away from the wearer's head. Unlike in FIG. 9A, in this example these portions do not take up additional space within the air gap, they directly help form part of the air gap.

Figure 9C:
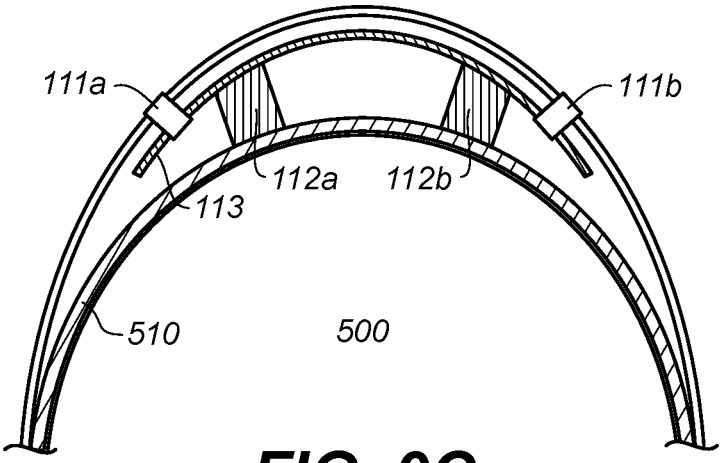

FIG. 9C depicts the arrangement of FIG. 9A with the addition of a sweatband 510 worn contacting the wearer's head and shown sitting between the wearer's head and the removable cooling device. Under extreme heat conditions or under high humidity or low wind conditions, there may not be sufficient air flow to fully evaporate all perspiration off a wearer's head. Without using an example removable cooling device, this excess perspiration soaks directly into hat 100. When an example removable cooling device is used, because hat 100 is now spaced away from the wearer's forehead, some of this excess perspiration may drip off the wearer's forehead down onto their face. Sweatband 510 is a small layer of absorptive material that can reduce the dripping of liquid perspiration under these conditions. It should be noted that compressible pads need not sit on sweatband 510. For example, sweatband 510 could be worn lower down on the wearer's forehead than the locations where compressible pads contact the forehead. Sweatband 510 can be worn whenever the wearer desires to keep perspiration from dripping, and the cooing device can also be located as desired.

FIG. 10 depicts one non-limiting example cooling device 600 with three compressible pads 612*a*, 612*b* and 612*c* affixed to thin flexible strip 613. Coupling structures are not shown but any arrangement of coupling structures described elsewhere may be used with this example. For example, separate coupling structures such as clips 111*a* and 111*b* can be used with clip 111*a* located between pads 612*a* and 612*b*, and a second clip 111*b* located between pads 612*b* and 612*c*. Alternatively, clips 111*a* and 111*b* could be located outboard of pads 612*a* and 612*c*. Pads 612*a*, 612*b* and 612*c* can be permanently fixed to thin flexible strip 613 or can be repositionable with respect to thin flexible strip 613. Generally, when there is a centrally located compressible pad, its location does not need to be altered and it is sufficient for only compressible pads 612*a* and 612*c* to be repositionable. Any of the methods describe elsewhere may be used to provide repositionable compressible pads for this example. Though not shown, pads 612*a* and 612*c* could be fixed directly to separate coupling structures forming devices such as removable cooling device 400 of FIG. 8. Depending on the spacing between compressible pads, it may be desirable for the outermost pads to have reduced thickness relative to the centrally mounted compressible pad. In some examples, uncompressed thickness 654 of outermost located compressible pads 612*a* and 612*c* is less than uncompressed thickness 653 of centrally located compressible pad 612*b*.

Human heads are not round but are more oval in shape where they are longer front to back that they are wide (ear to ear). This causes hats to primarily exert force on the front and back of the head. For a compressible pad that is centrally located, the force applied to the pad to hold it against the wearer's head is normal to the plane of the pad. As a compressible pad is moved more toward the side of the head, the applied force is no longer normal but acts at an angle relative to the plane of the pad. This tends to push one corner of the compressible pad into the head much more than the other. For compressible pads mounted to more rigid structures such as clips 111*a* and 111*b* or as shown in FIG. 8, a corner of the clip can be pulled into the wearer's head which can become uncomfortable. For this reason, relocatable pads such as described with respect to FIG. 5B may be preferrable for pads moved farther to the outside than relocatable pads as shown in FIG. 8.

Figure 11A:
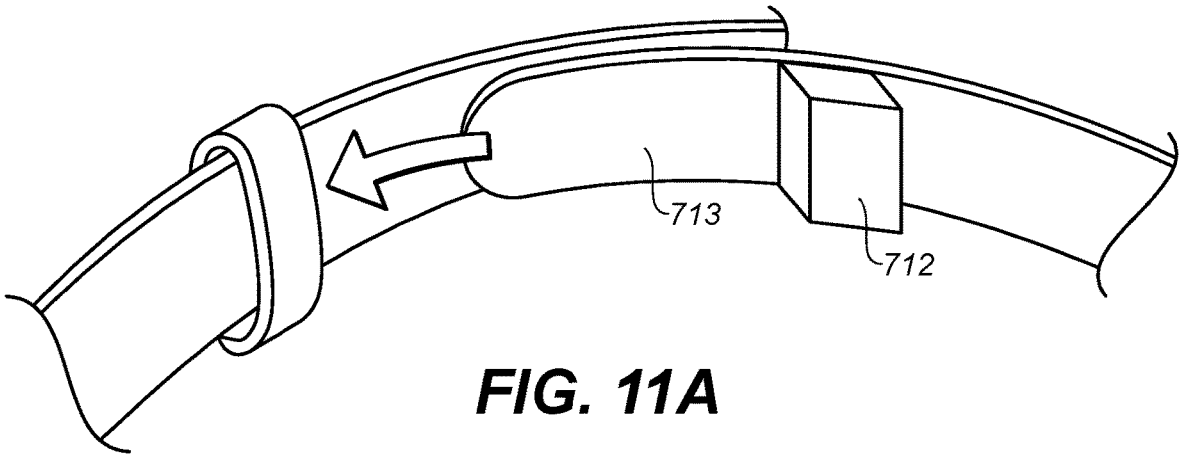
FIG. 11A depicts one method for inserting a thin flexible strip that is part of a removable cooling device into a coupling structure.
Figure 11B:
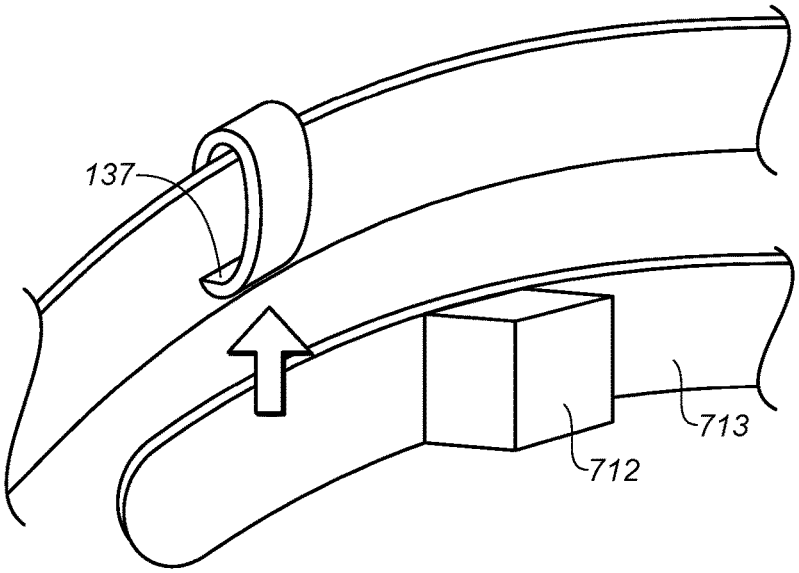
FIG. 11B depicts an alternative method for inserting a thin flexible strip that is part of a removable cooling device into a coupling structure.

FIGS. 11A and 11B depict methods for attaching removable cooling devices to a hat. Though FIGS. 11A and 11B depict a removable cooling device with a compressible pad 712 attached to a thin flexible strip 713, these methods of attachment also work for any example cooling device disclosed herein using a thin flexible strip. FIGS. 11A and 11B also only show one end of the thin flexible strip. In FIG. 11A, coupling structure 711 is first inserted onto headband 102 prior to attaching thin flexible strip 713. Once coupling structure 711 is in place, thin flexible strip 713 is slid into the side of coupling structure 711.

FIG. 11B depicts an alternative attachment method of thin flexible strip 713 to coupling structure 711. Again, coupling structure 711 is first inserted onto headband 102. Thin flexible strip 713 is then inserted into the bottom of coupling structure 711 and is pushed up into coupling structure 711 until thin flexible strip 713 snaps over a retaining ridge (such as retaining step 137 of clip 111*a* as shown in FIG. 4) in coupling structure 711.

At the time coupling structure 711*a* is inserted onto headband 102, the user can also attach a second coupling structure to headband 102 in the same manner (not shown). Alternatively, the user could insert a first coupling structure, then insert one end of the thin flexible strip into the coupling structure prior to inserting a second coupling structure onto the headband. Once the second coupling structure has been inserted onto the headband 102, a second end of the thin flexible strip is coupled to the second coupling structure. Either of the methods shown in FIGS. 11A and 11B can be used to insert the second end into the second coupling structure. However, it has been found to be somewhat easier to insert the second end of the thin flexible strip into the bottom of the second coupling structure. It should also be noted that if one desired to arrange coupling structures as shown in FIG. 2B, the method of inserting the thin flexible strip into the bottom of the coupling structure should be used because the compressible pads would interfere with sliding into sides of the coupling structures. If an example removable cooling device is used where compressible pads can be separated from the thin flexible strip, then the thin flexible strip can be attached to the hat using either method for either coupling structure and the compressible pads attached to the thin flexible strip after it is in place.

It should be noted that a third method of coupling removable cooling devices to the headband of a hat is to place the thin flexible strip in its desired location in the hat and then snap the coupling structures over the headband and the thin flexible strip at the same time. However, for a coupling structure designed to more aggressively grab onto the hat headband, this proves to be practically difficult and the methods of FIG. 11A or 11B are preferred.

FIGS. 12A and 12B depict front and back perspective views of one end of example 800 of a thin flexible strip with an integral formed coupling structure. Thin flexible strip 800 includes flat section 813 and coupling structure 816, which is shown as a simple spring clip. Example removable cooling devices with integral coupling structures would include at least a pair of integral coupling structures. Coupling structure 816 fits over headband 102 of hat 100 to hold thin flexible strip 800 against the headband. FIGS. 12A and 12B do not show compressible pads. Any arrangement of compressible pads described elsewhere (permanently attached or removably coupled to thin flexible strips) can be used with a thin flexible strip having integral coupling structures. However, using an arrangement such as device 400 of FIG. 8 would be redundant as coupling structure 816 performs the function of coupling structure 411 of FIG. 8. Since, however, a device 400 would allow the location of compressible pads to be varied, use of such a structure is also contemplated herein.

If example removable cooling structure 800 is formed using a process such as injection molding, it is possible to adjust the wall thickness so that the spring clip 816 portion of the device may have a different wall thickness that the flat portion 813 of the device. This allows the bending stiffness of the thin flexible strip to be adjusted independently of the spring constant of the spring clip 816. One further benefit of device 800 is that no additional coupling structures that could protrude into the air gap and potentially restrict air flow are required.

Device 900 is shown in FIG. 13 with compressible pads 912*a* and 912*b* attached. Any attachment methods disclosed elsewhere for attaching compressible pads to thin flexible strips (permanently attaching or removably coupling) is applicable to this example. Slits 915*a* and 915*b* are arranged to accommodate headband 102. When device 900 is coupled to headband 102, sections 916 and 917 fit behind headband 102 and section 918 sits in front of headband 102. Any portion of device 900 that incorporates a compressible pad needs to sit in front of headband 102 so that headband 102 does not interfere with the pad. The entirety of thin flexible strip 913 including coupling structures 915 can be easily formed from flat sheet material with a die cutting operation.

It is possible to add friction enhancing elements to a thin flexible strip, to help keep it in place. Since it is desired to enhance friction between the thin flexible strip and the headband, the front facing surface of sections 916 and 917 and the rear facing surface of section 918 may have friction enhancing structures formed therein. This can be done, for example, by pressing a small, heated form like a pin into the thin flexible strip to push small areas out away from surface of the thin flexible strip, towards the direction where the headband would be located.

Though a number of examples disclosed have describes various parts of the removable cooling apparatus as separate elements, many of these components can be formed together. For example, a compressible foam pad can be formed directly onto a coupling structure such as a clip in a 2-part injection molding process where first the coupling structure is formed, then the foam pad is formed and bonded to the coupling structure in the tool. A 2-part injection process could also be used to form compressible pads integrally with thin flexible strips, or a separately formed thin flexible strip can be inserted into a tool and a foamed pad can be then formed in the tool and bonded to the thin flexible strip.

A number of implementations have been described. Nevertheless, it will be understood that additional modifications may be made without departing from the scope of the inventive concepts described herein, and, accordingly, other embodiments are within the scope of the following claims.

What is claimed is:

1. A removable cooling apparatus for a hat comprising:

a first thin flexible strip constructed and arranged to elastically deform to conform to the curvature of a headband of a hat, one or more compressible pads, and;

removable coupling structures for removably coupling the first thin flexible strip to the headband of the hat, the coupling structures having a width, wherein the removable coupling structures are constructed and arranged to apply a coupling force to hold the first thin flexible strip in place against the headband, wherein the removable coupling structures are constructed and arranged to allow the first thin flexible strip to slide within the removable coupling structures along the headband of the hat, when the removable cooling apparatus is coupled to the hat, wherein the removable coupling structures are further constructed and arranged to allow repeated coupling and uncoupling of the first thin flexible strip to the headband of the hat without substantive degradation of an ability of the removable coupling structures to hold the thin flexible strip in place against the headband, wherein the removable cooling apparatus is constructed and arranged so that when the removable cooling apparatus is completely removed from the hat, the hat is in an unaltered state, and;

wherein the removable cooling apparatus is constructed and arranged so that when the removable cooling apparatus is coupled to the hat and the hat is worn by a wearer, the one or more compressible pads contact a head of the wearer.

2. The removable cooling apparatus of claim 1 wherein the one or more compressible pads are repositionable with respect to the first thin flexible strip.

3. The removable cooling apparatus of claim 1 wherein the one or more compressible pads are permanently fixed to the first thin flexible strip.

4. The removable cooling apparatus of claim 1 wherein the removable coupling structures are constructed and arranged to be slidable relative to the headband of the hat.

5. The removable cooling apparatus of claim 4 wherein the one or more compressible pads are affixed to the removable coupling structures.

6. The removable cooling apparatus of claim 1 wherein the removable coupling structures comprise spring clips.

7. The removable cooling apparatus of claim 6 wherein the spring clips further comprise a retaining feature that extends outward from the body of the clips toward the headband to help retain the first thin flexible strip in place within the clips after it has been inserted into the clips, when the clips are coupled to the headband.

8. The removable cooling apparatus of claim 1 wherein the coupling structures are formed integral with the first thin flexible strip.

9. The removable cooling apparatus of claim 1 wherein the one or more compressible pads together have a combined projected planar surface area for contact with the wearer's head of between 400 and 2000 sq. mm.

10. The removable cooling apparatus of claim 1 wherein the first thin flexible strip has a first thickness, wherein the first thickness is less than 1.5 mm.

11. The removable cooling apparatus of claim 1 wherein the removable coupling structures comprise a first pair of removable coupling structures for coupling the thin flexible strip to the headband, wherein the removable cooling apparatus further comprises a second pair of removable coupling structures, wherein the one or more compressible pads comprise a pair of compressible pads, wherein the pair of compressible pads are attached to the second pair of removable coupling structures, and;

wherein the second pair of removable coupling structures are constructed and arranged to couple to the thin flexible strip.

12. The removable cooling apparatus of claim 1 wherein the one or more compressible pads comprise at least first and second compressible pads positioned on the first thin flexible strip such that first and second ends of the thin flexible strip each extend beyond an outer extent of each of the one or more compressible pads by a distance at least as great as the width of one removable coupling structure.

13. The removable cooling apparatus of claim 1 further comprising a second thin flexible strip and the one or more compressible pads comprise at least first and second compressible pads, wherein the first compressible pad is fixed to the first thin flexible strip and the second compressible pad is fixed to the second thin flexible strip.

14. The removable cooling apparatus of claim 13 wherein the first and second thin flexible strips are intercoupled and slideable relative to each other.

15. The removable cooling apparatus of claim 13 further comprising a third thin flexible strip, wherein each of the first and second thin flexible strips is coupled to the third thin flexible strip, wherein the first and second thin flexible strips are repositionable with respect to the third thin flexible strip.

16. The removable cooling apparatus of claim 1 wherein the one or more compressible pads comprises at least first and second compressible pads, wherein the first and second compressible pads are spaced apart a distance, wherein the distance is greater than the width of a removable coupling structure and is less than 120 mm.

17. The removable cooling apparatus of claim 1 wherein the one or more compressible pads comprise first, second and third compressible pads that are each coupled to the first thin flexible strip, wherein the third compressible pad is located between the first and second compressible pads, wherein an uncompressed thickness of the first and second compressible pads is less than an uncompressed thickness of the third compressible pad.

18. A removable cooling apparatus for a hat comprising:

a thin flexible strip having a width, the thin flexible strip constructed and arranged to elastically deform to conform to the curvature of a headband of a hat, first and second compressible pads, and, removable coupling structures, wherein the removable coupling structures comprise first and second pairs of removable coupling structures, wherein the first pair of removable coupling structures are constructed and arranged to apply a coupling force to hold the thin flexible strip in place against the headband of the hat, wherein the second pair of removable coupling structures are constructed and arranged to couple to the thin flexible strip, and further constructed and arranged to be slidable relative to the thin flexible strip, when the removable cooling apparatus is coupled to the hat, wherein the first compressible pad is attached to one of the second pair of removable coupling structures, and the second compressible pad is attached to the other of the second pair of removable coupling structures, and;

wherein the removable cooling apparatus is constructed and arranged so that when the removable cooling apparatus is coupled to the hat and the hat is worn by a wearer, the first and second compressible pads contact a head of the wearer.

* * * * *